US010286669B2

(12) United States Patent
Takahashi

(10) Patent No.: US 10,286,669 B2
(45) Date of Patent: May 14, 2019

(54) LIQUID CARTRIDGE HAVING AIR COMMUNICATION PIPE AND LIQUID-CONSUMING DEVICE USING THE SAME

(71) Applicant: BROTHER KOGYO KABUSHIKI KAISHA, Nagoya-shi, Aichi-ken (JP)

(72) Inventor: Hiroaki Takahashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 12 days.

(21) Appl. No.: 15/664,128

(22) Filed: Jul. 31, 2017

(65) Prior Publication Data

US 2018/0272742 A1 Sep. 27, 2018

(30) Foreign Application Priority Data

Mar. 27, 2017 (JP) ..... 2017-061899

(51) Int. Cl.
*B41J 2/175* (2006.01)
*B41J 2/19* (2006.01)

(52) U.S. Cl.
CPC ..... *B41J 2/17513* (2013.01); *B41J 2/1752* (2013.01); *B41J 2/17506* (2013.01); *B41J 2/17509* (2013.01); *B41J 2/17523* (2013.01); *B41J 2/17553* (2013.01); *B41J 2/19* (2013.01)

(58) Field of Classification Search
CPC ..... B41J 2/17506; B41J 2/17513
See application file for complete search history.

(56) References Cited

U.S. PATENT DOCUMENTS 5,801,737 A 9/1998 Sato et al.
2005/0243147 A1* 11/2005 Qingguo ..... B41J 2/17513 347/84
2006/0215002 A1 9/2006 Ishizawa et al.
2009/0262171 A1* 10/2009 Yamashita ..... B41J 2/17506 347/86
2016/0059572 A1* 3/2016 Kobayashi ..... B41J 2/17513 347/86

FOREIGN PATENT DOCUMENTS

JP H07-314709 A 12/1995
JP 2007-253328 A 10/2007

* cited by examiner

*Primary Examiner* — Kristal Feggins
*Assistant Examiner* — Kendrick X Liu
(74) *Attorney, Agent, or Firm* — Merchant & Gould P.C.

(57) ABSTRACT

A liquid cartridge includes a cartridge body including: a liquid storage chamber, a liquid supply portion providing a liquid supply hole supplying the liquid in the liquid storage chamber to an outside, an air communication passage communicating liquid storage chamber with an atmosphere, a front wall, a rear wall spaced apart from the front wall, a lower wall connecting a lower end of the front wall and a lower end of the rear wall, and an upper wall extending between the front wall and the rear wall. The air communication passage includes an air communication pipe having one open end positioned downward relative to a highest liquid level and upward relative to an up-down center portion of the liquid storage chamber. The highest liquid level is defined in a state where a maximum permissible amount of liquid is stored in the liquid storage chamber.

15 Claims, 14 Drawing Sheets

LIQUID CARTRIDGE HAVING AIR COMMUNICATION PIPE AND LIQUID-CONSUMING DEVICE USING THE SAME

CROSS REFERENCE TO RELATED APPLICATION

This application claims priority from Japanese Patent Application No. 2017-061899 filed Mar. 27, 2017. The entire content of the priority application is incorporated herein by reference.

TECHNICAL FIELD

The present disclosure relates to a liquid cartridge having: a casing formed with a liquid storage chamber; and a liquid supply hole configured to supply the liquid stored in the liquid storage chamber to an outside. The present disclosure also relates to a liquid-consuming device to which the liquid cartridge is attachable.

BACKGROUND

A printer including a recording head for ejecting ink supplied from an ink cartridge through nozzles is known in the art. In such the printer, when liquid surface of ink stored in an ink storage chamber of the ink cartridge is positioned higher than the nozzles, meniscuses formed in the nozzles may be broken due to water head difference between liquid surface of the ink stored in the ink storage chamber and the nozzles. Thus, liquid surface level of the ink stored in the ink storage chamber need be lower than or equal to positions of the nozzles. This structure causes reduction of amount of ink that can be stored in the ink storage chamber.

In order to solve the above problem, Japanese Patent Application Publication No. 2007-253328 discloses an ink cartridge provided with a pipe extending from an upper end portion of an ink storage chamber toward a lower portion of the ink storage chamber. The pipe has an upper end in communication with outside of the ink storage chamber, i.e., an atmosphere, and a lower end in communication with the ink storage chamber. With this configuration, instead of the liquid surface of the ink in the ink storage chamber, a position of the lower end of the pipe is compared to the positions of the nozzles as a reference position of the water head difference between the ink storage chamber and the nozzles. Accordingly, the liquid surface level of the ink in the ink storage chamber can be higher than the positions of the nozzles as long as the lower end of the pipe is positioned lower than the nozzles. Consequently, a large amount of ink can be stored in the ink storage chamber.

SUMMARY

However, when the pipe extends up toward the lower portion of the ink storage chamber as disclosed in Japanese Patent Application Publication No. 2007-253328, the following problem may arise.

If the ink cartridge is transferred to a highland after the ink cartridge is manufactured, the atmospheric pressure of an outside of the ink cartridge becomes low. Then, ink stored in the ink storage chamber may be pumped out by the pipe in communication with the outside of the ink cartridge. This may cause leakage of ink to the outside of the ink cartridge.

In this case, if the pipe extends up to the lower portion of the ink storage chamber, a large amount of ink may be leaked to the outside through the pipe.

In view of the foregoing, it is an object of the present disclosure to provide a liquid cartridge capable of suppressing leakage of liquid stored in the liquid storage chamber.

In order to attain the above and other objects, according to one aspect, the disclosure provides a liquid cartridge including a cartridge body having a liquid storage chamber configured to store liquid therein. The cartridge body includes: a liquid supply portion, an air communication passage, a front wall, a rear wall, a lower wall, and an upper wall. The liquid supply portion provides a liquid supply hole configured to supply the liquid stored in the liquid storage chamber to an outside of the liquid cartridge. The air communication passage is configured to communicate the liquid storage chamber with an atmosphere. The air communication passage includes an air communication pipe extending in a gravitational direction in an upright posture of the liquid cartridge. The air communication pipe has one open end open to the liquid storage chamber and another open end opposite to the one open end. The another open end is positioned upward relative to the one open end in the upright posture of the liquid cartridge. The rear wall is spaced apart from the front wall in a front-rear direction perpendicular to the gravitational direction in the upright posture of the liquid cartridge. The lower wall connects a lower end of the front wall and a lower end of the rear wall in the upright posture of the liquid cartridge. The upper wall extends in the front-rear direction between the front wall and the rear wall. The liquid storage chamber is positioned between the upper wall and the lower wall in the gravitational direction in the upright posture of the liquid cartridge. The air communication pipe protrudes from the upper wall. The front wall, the rear wall, the lower wall and the upper wall defines the liquid storage chamber. The one open end is positioned downward relative to a highest liquid level and upward relative to a center portion of the liquid storage chamber in an up-down direction parallel to the gravitational direction in the upright posture of the liquid cartridge. The highest liquid level is defined in a state where a maximum permissible amount of liquid is stored in the liquid storage chamber in the upright posture of the liquid cartridge.

According to another aspect, the disclosure provides a liquid-consuming device includes: a liquid cartridge, a cartridge attachment section to which the liquid cartridge is attachable, and a consuming section. The liquid cartridge includes a cartridge body having a liquid storage chamber configured to store liquid therein. The cartridge body includes: a liquid supply portion, an air communication passage, a front wall, a rear wall, a lower wall, and an upper wall. The liquid supply portion provides a liquid supply hole configured to supply the liquid stored in the liquid storage chamber to an outside of the liquid cartridge. The air communication passage is configured to communicate the liquid storage chamber with an atmosphere. The air communication passage includes an air communication pipe extending in a gravitational direction in an upright posture of the liquid cartridge. The air communication pipe has one open end open to the liquid storage chamber and another open end opposite to the one open end. The another open end is positioned upward relative to the one open end in the upright posture of the liquid cartridge. The rear wall is spaced apart from the front wall in a front-rear direction perpendicular to the gravitational direction in the upright posture of the liquid cartridge. The lower wall connects a lower end of the front wall and a lower end of the rear wall in the upright posture of the liquid cartridge. The upper wall extends in the front-rear direction between the front wall and the rear wall. The liquid storage chamber is positioned between the upper wall and the lower wall in the gravitational direction in the upright posture of the liquid cartridge. The air communication pipe protrudes from the upper wall. The front wall, the rear wall, the lower wall and the upper wall defines the liquid storage chamber. The one open end is positioned downward relative to a highest liquid level and upward relative to a center portion of the liquid storage chamber in an up-down direction parallel to the gravitational direction in the upright posture of the liquid cartridge. The highest liquid level is defined in a state where a maximum permissible amount of liquid is stored in the liquid storage chamber in the upright posture of the liquid cartridge. The cartridge body includes a buffer chamber positioned above the upper wall in the upright posture of the liquid cartridge and defined by a plurality of surfaces. The buffer chamber constitutes a part of the air communication passage. The buffer chamber is formed with a liquid storage chamber side opening and an external side opening. The liquid storage chamber side opening is communicated with the air communication pipe to communicate the buffer chamber with the liquid storage chamber. The external side opening is configured to communicate the buffer chamber with the outside of the cartridge body. The buffer chamber is formed in the cartridge body at a region between a first position and a second position. The first position is closer to the front wall than a center portion in the front-rear direction of the liquid storage chamber is to the front wall. The second position is closer to the rear wall than the center portion in the front-rear direction of the liquid storage chamber is to the rear wall. The buffer chamber has an internal volume. The cartridge-attachment section has a main body side liquid storage chamber configured to be communicated with the liquid supply hole of the liquid cartridge to store liquid supplied through the liquid supply hole in a state where the liquid cartridge is attached to the cartridge-attachment section. The main body side liquid storage chamber has an internal volume greater than the internal volume of the buffer chamber. The consuming section is configured to consume the liquid stored in the main body side liquid storage chamber.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Figure 1:
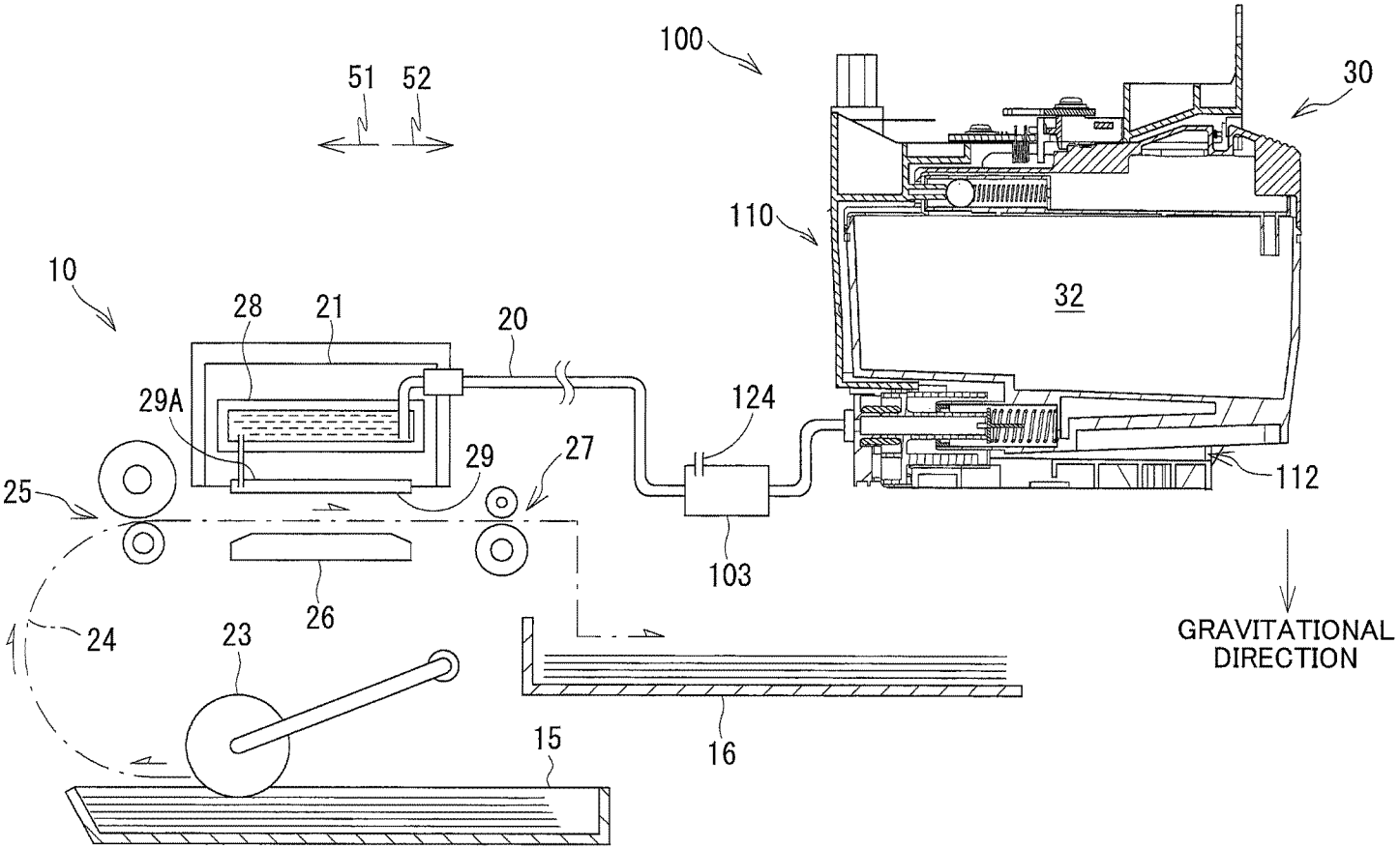
FIG. 1 is a schematic vertical cross-sectional diagram conceptually illustrating an internal configuration of a printer 10 provided with a cartridge attachment section 110 to which an ink cartridge 30 according to one embodiment of the present disclosure is detachably attached.

Hereinafter, one embodiment of the present disclosure will be described in detail while referring to accompanying drawings, wherein like parts and components are designated by the same reference numerals to avoid duplicating description. It would be apparent to those skilled in the art that the embodiment described below is merely an example of the present disclosure and modifications and variations may be made therein without departing from the scope of the disclosure.

In the following description, a direction in which an ink cartridge 30 according to the embodiment is inserted into a cartridge attachment section 110 is defined as a frontward direction 51, while a direction in which the ink cartridge 30 is extracted from the cartridge attachment section 110 is defined as a rearward direction 52. Throughout the specification, the ink cartridge 30 is inserted to and extracted from the cartridge attachment section 110 in the horizontal direction. Therefore, the frontward direction 51 and the rearward direction 52 are described to be parallel to the horizontal direction, but the frontward direction 51 and the rearward direction 52 need not be parallel to the horizontal direction.

Further, a direction perpendicular to the frontward direction 51 or the rearward direction 52 is defined as a downward direction 53, while a direction opposite to the downward direction 53 is defined as an upward direction 54. Further, a direction perpendicular to the frontward direction 51 and the downward direction 53 is defined as a rightward direction 55, while a direction opposite to the rightward direction 55 is defined as a leftward direction 56. Accordingly, in a state where the ink cartridge 30 has been received in the cartridge attachment section 110 and used by a printer 10, the downward direction 53 is coincident with a direction of a gravitational force acting on the ink cartridge 30 (i.e. gravitational direction), and the upward direction 54 is a direction opposite to the gravitational direction. That is, in the state where the ink cartridge 30 has been received in the cartridge attachment section 110 and used by the printer 10, an outer surface of a bottom wall 42 of a cartridge body 31 faces downward, that is, faces in the gravitational direction.

Further, the rightward direction 55 and the leftward direction 56 are defined as directions perpendicular to the frontward direction 51 and the downward direction 53. More specifically, when a user views the ink cartridge 30 from its rear side in a state where the ink cartridge 30 has been received in the cartridge attachment section 110 and used by the printer 10, the rightward direction 55 is a direction toward the right and the leftward direction 56 is a direction toward the left.

Incidentally, "in a state where the ink cartridge 30 has been received in the cartridge attachment section 110 and used by the printer 10" denotes that a state where the ink cartridge 30 has been inserted into an attachment position in the cartridge attachment section 110. When the ink cartridge 30 is in the attachment position, an ink needle 102 provided at the cartridge attachment section 110 is inserted to an ink supply portion 34 of the ink cartridge 30 to be coupled to the ink supply portion 34, and an IC board 64 provided at the ink cartridge 30 is in contact with contacts 106 provided at the cartridge attachment section 110. Hereinafter, a posture of the ink cartridge 30 in a state where the ink cartridge 30 has been received in the cartridge attachment section 110 and used by the printer 10 will be referred to as an "operational posture".

Further, the frontward direction 51 and the rearward direction 52 will be collectively referred to as a front-rear direction. The upward direction 54 and the downward direction 53 will be collectively referred to as an up-down direction. The rightward direction 55 and the leftward direction 56 will be collectively referred to as a left-right direction (an example of a widthwise direction).

Further, in the following description, "facing frontward" includes facing in a direction including a frontward component, "facing rearward" includes facing in a direction including a rearward component, "facing downward" includes facing in a direction including a downward component, and "facing upward" includes facing in a direction including an upward component. For example, "a front surface faces frontward" denotes that the front surface may face in a frontward direction, or the front surface may face in a direction inclined relative to the frontward direction.

<Overview of Printer 10>

A printer 10 provided with a cartridge attachment section 110 to which an ink cartridge 30 according to one embodiment is detachably attached will be described with reference to FIG. 1.

The printer 10 (an example of a liquid-consuming device) is an image recording apparatus configured to form an image by ejecting ink droplets onto a sheet based on an inkjet recording system. The printer 10 is, for example, an inkjet printer. As illustrated in FIG. 1, the printer 10 includes a recording head 21 (an example of a consuming section), an ink-supplying device 100, and ink tubes 20 connecting the recording head 21 to the ink-supplying device 100. The ink-supplying device 100 includes the cartridge attachment section 110. The cartridge attachment section 110 can detachably accommodate the ink cartridge 30 (an example of a liquid cartridge) therein.

The cartridge attachment section 110 has a surface formed with an opening 112. The ink cartridge 30 can be inserted into the cartridge attachment section 110 in the frontward direction 51 through the opening 112, and extracted from the cartridge attachment section 110 in the rearward direction 52 through the opening 112.

The ink cartridge 30 stores liquid therein that the printer 10 can use for printing, for example, ink. The ink cartridge 30 is connected to the recording head 21 through the corresponding ink tube 20 when the ink cartridge 30 has been completely mounted in the cartridge attachment section 110. The recording head 21 includes dumper chambers 28 for temporarily storing ink supplied from the ink cartridge 30 through the corresponding ink tube 20. The recording head 21 also includes a plurality of nozzles 29 through which the ink supplied from the respective dumper chamber 28 is ejected. More specifically, the recording head 21 includes a head control board (not shown), and a plurality of piezoelectric elements 29A each corresponding to one of the plurality of nozzles 29. The head control board is configured to selectively apply drive voltages to the plurality of piezoelectric elements 29A to eject ink selectively from the nozzles 29. In this way, the recording head 21 is configured to consume the ink stored in the ink cartridge 30 that has been completely mounted in the cartridge attachment section 110.

The printer 10 also includes a sheet tray 15, a sheet feeding roller 23, a conveying path 24, a pair of conveying rollers 25, a platen 26, a pair of discharge rollers 27, and a sheet discharge tray 16. The sheet feeding roller 23 is configured to feed sheets on the sheet tray 15 toward the conveying path 24. The sheets fed toward the conveying path 24 reaches the conveying rollers 25, and then conveyed by the conveying rollers 25 onto the platen 26. The recording head 21 is configured to selectively eject ink onto the sheets as the sheets move over the platen 26, thereby recording images on the sheets. The sheets that have passed the platen 26 are then discharged by the discharge rollers 27 onto the sheet discharge tray 16 disposed at a downstream end of the conveying path 24.

<Ink-Supplying Device 100>

The ink-supplying device 100 is provided in the printer 10, as illustrated in FIG. 1. The ink-supplying device 100 functions to supply ink to the recording head 21. The ink-supplying device 100 includes the cartridge attachment section 110 for detachably receive the ink cartridge 30 therein, tanks 103, and the ink tubes 20. FIG. 1 illustrates a state where the ink cartridge 30 has been completely received in the cartridge attachment section 110. That is, the ink cartridge 30 is in its attached state in FIG. 1. A posture of the ink cartridge 30 in the attached state is the operational posture.

<Cartridge Attachment Section 110>

Figure 2:
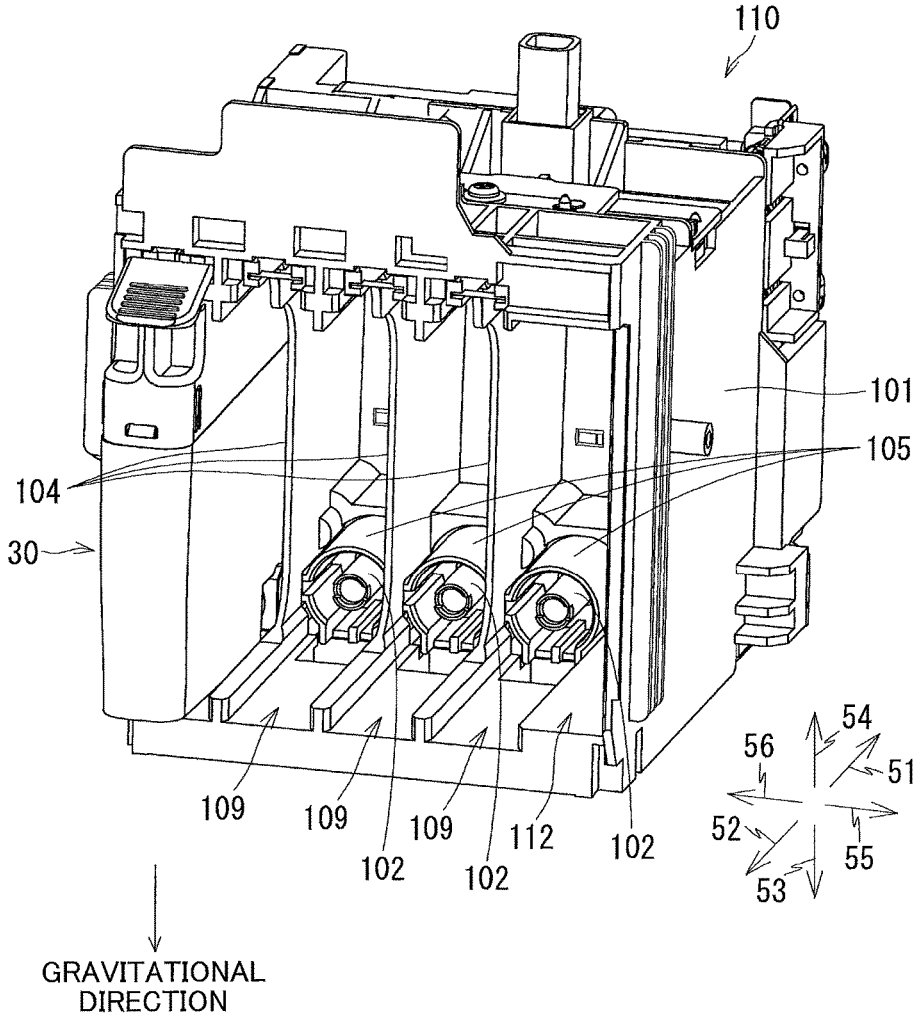
FIG. 2 is a perspective view illustrating an external appearance of the cartridge attachment section 110 as viewed from a rear side thereof.
Figure 3:
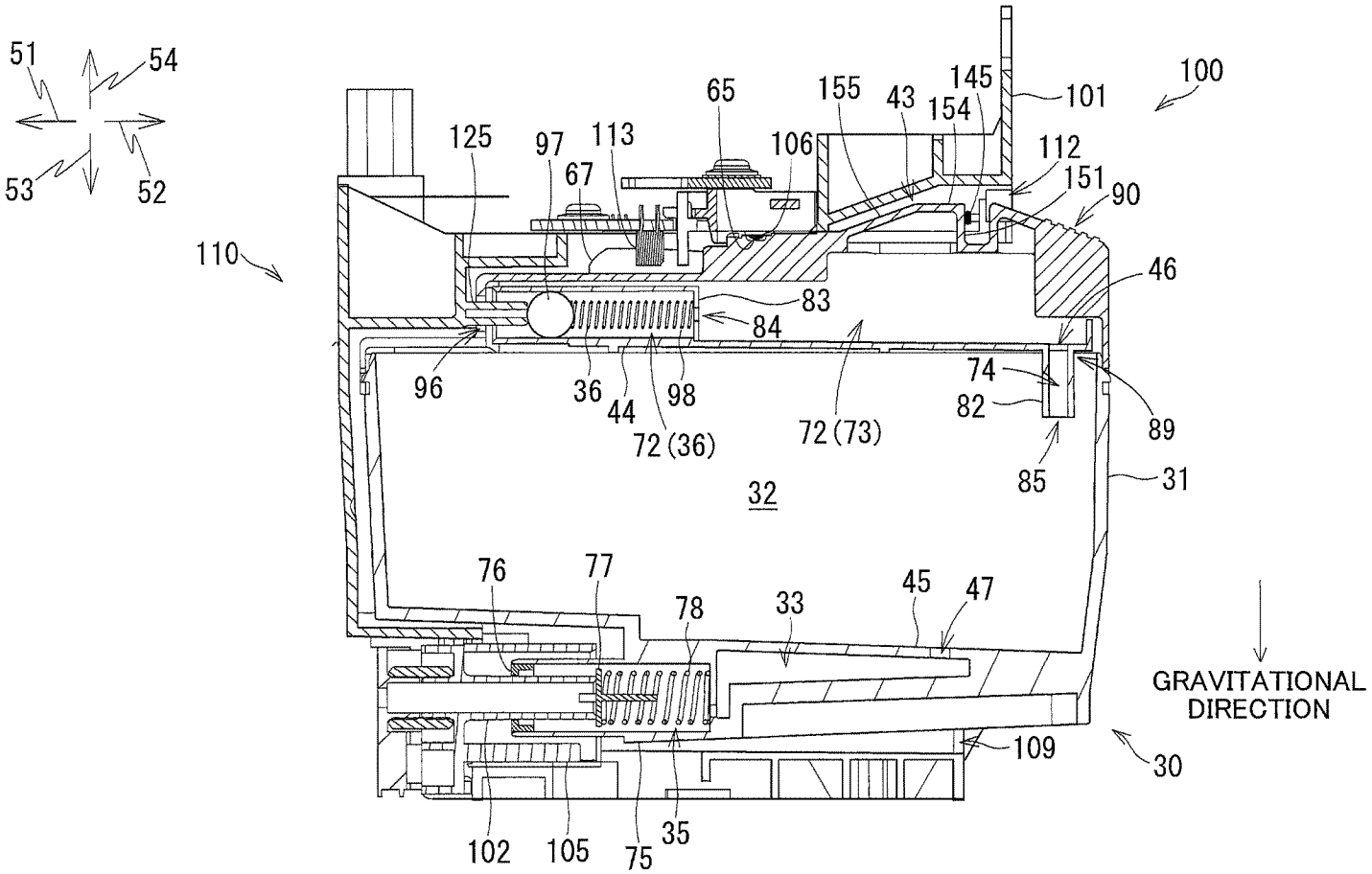
FIG. 3 is a vertical cross-sectional view of the ink cartridge 30 according to the embodiment and the cartridge attachment section 110, and illustrating a state in which the ink cartridge 30 has been completely attached to the cartridge attachment section 110.
Figure 4:
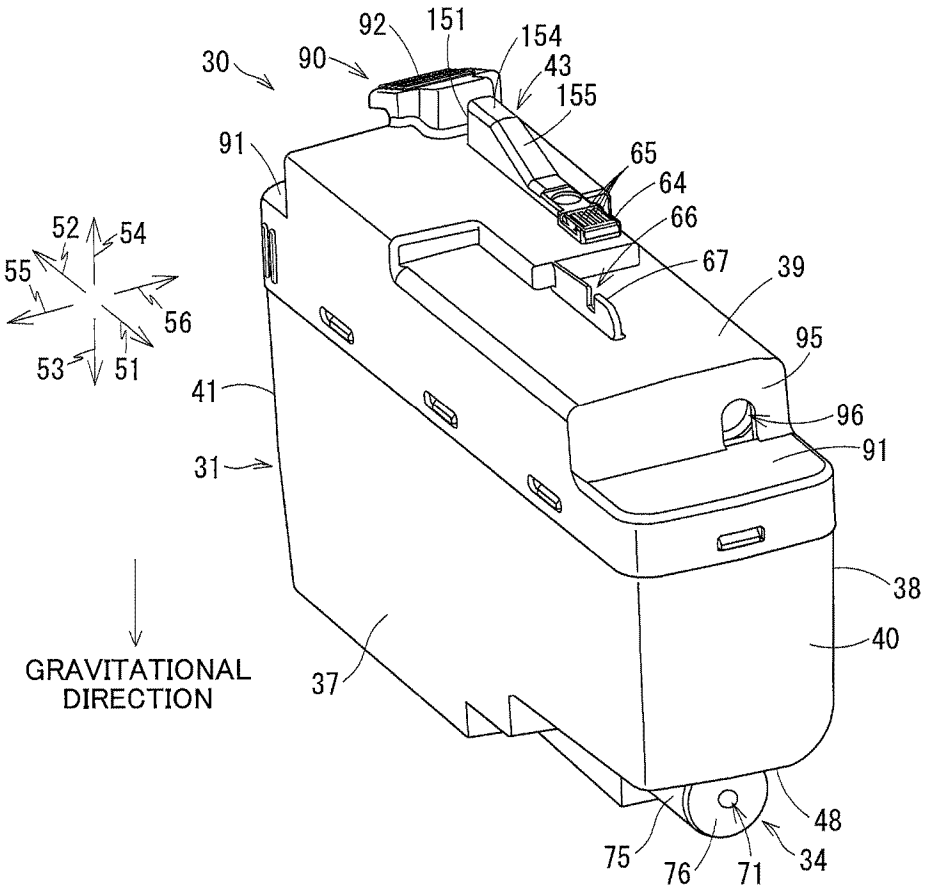
FIG. 4 is a perspective view of the ink cartridge 30 according to the embodiment as viewed from a front side thereof.
Figure 5:
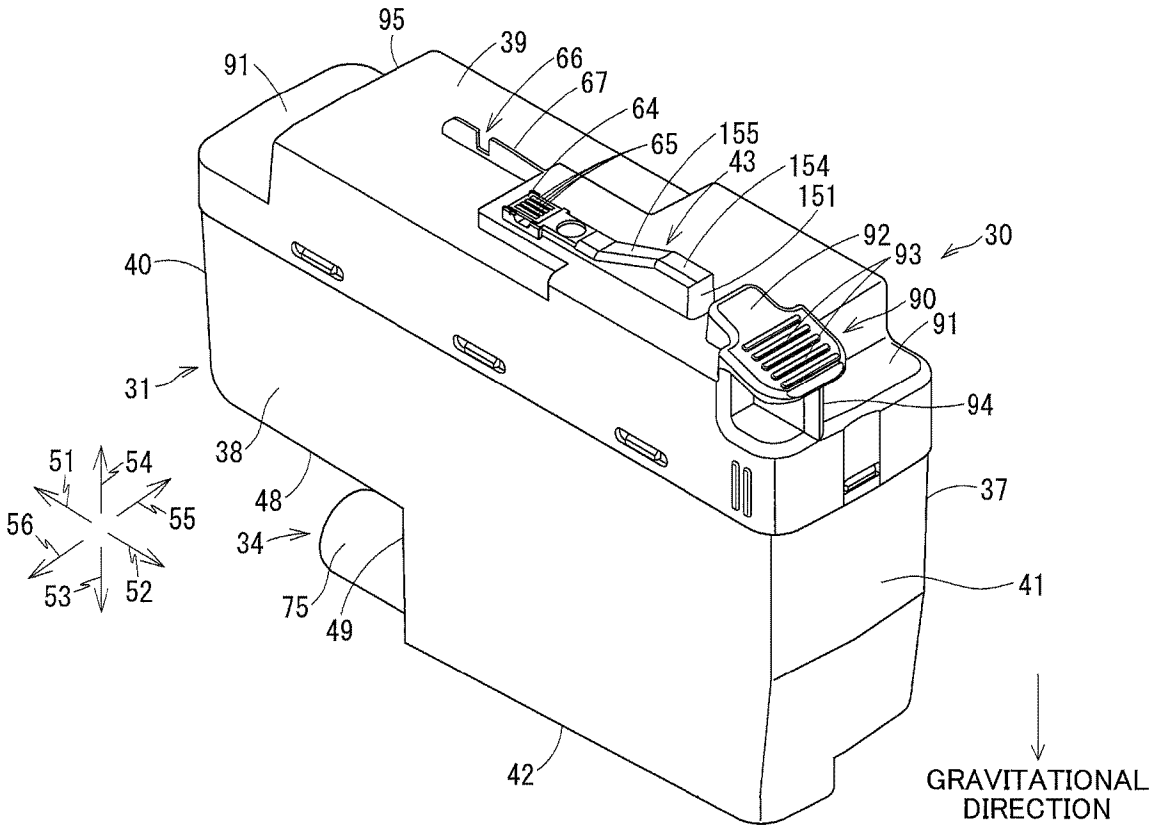
FIG. 5 is a perspective view of the ink cartridge 30 according to the embodiment as viewed from a rear side thereof.

As illustrated in FIGS. 1 through 3, the cartridge attachment section 110 includes a cartridge case 101, ink needles 102, optical sensors 113, contacts 106, and the tanks 103. In the cartridge attachment section 110, four kinds of ink cartridges 30 corresponding to four colors of cyan, magenta, yellow and black are detachably mountable. One ink needle 102, one optical sensor 113, and one tank 103 are provided corresponding to each of the four kinds of ink cartridges 30. Further, four contacts 106 are provided corresponding to each of the four kinds of ink cartridges 30. That is, 16 (sixteen) contacts 106 are disposed corresponding to the four ink cartridges 30. Further, one ink tube 20 are provided corresponding to each of the four kinds of ink cartridges 30 to be connected to the corresponding tank 103.

<Cartridge Case 101>

As illustrated in FIG. 2, the cartridge case 101 constitutes a casing of the cartridge attachment section 110. The cartridge case 101 has a box-like shape defining an internal space therein. Specifically, the cartridge case 101 includes a top wall defining a top part (upper portion) of the internal space, a bottom wall defining a bottom (lower portion) of the internal space, an end wall connecting the top wall and the bottom wall, and formed with the opening 112 positioned opposite the end wall in the front-rear direction. The opening 112 can be exposed to a surface (user-interface surface) that a user can face when using the printer 10.

The four kinds of ink cartridges 30 can be inserted into and removed from the cartridge case 101 through the opening 112. The bottom wall of the cartridge case 101 is formed with guide grooves 109 for guiding insertion/removal of the ink cartridges 30. Specifically, when the ink cartridge 30 is inserted into and removed from the cartridge case 101 through the opening 112, lower end of the ink cartridge 30 is received in the corresponding guide groove 109 and guided thereby in the front-rear direction. Further, the cartridge case 101 also includes three plates 104 that partition the internal space into four individual spaces each elongated in the up-down direction. Each of the four kinds of ink cartridges 30 can be mounted in a corresponding one of the four spaces defined by the plates 104.

Hereinafter, for simplifying explanation, only one ink cartridge 30 is assumed to be mounted in the cartridge case 101 of the cartridge attachment section 110 unless otherwise noted.

<Ink Needle 102>

As illustrated in FIG. 2, each ink needle 102 has a generally tubular shape and disposed on a lower portion of the end wall constituting the cartridge case 101. Specifically, the ink needles 102 are disposed at positions corresponding to corresponding ink supply portions 34 (described later) of the ink cartridges 30 mounted in the cartridge attachment section 110. Each ink needle 102 protrudes rearward from the end wall of the cartridge case 101.

Four cylindrical-shaped guides 105 are provided at the end wall of the cartridge case 101 to surround the corresponding ink needles 102. Each guide 105 protrudes rearward from the end wall of the cartridge case 101 and has a protruding end that is open rearward. Specifically, each ink needle 102 is positioned at a diametrical center of the corresponding guide 105. Each guide 105 is shaped to allow the ink supply portion 34 of the corresponding ink cartridge 30 to be received in the corresponding guide 105.

During insertion process of the ink cartridge 30 into the cartridge attachment section 110 in the frontward direction 51, i.e., in the course of action for bringing the ink cartridge 30 into an attachment position mounted in the cartridge attachment section 110, the ink supply portion 34 of the ink cartridge 30 enters the guide 105 (see FIG. 3). As the ink cartridge 30 is further inserted frontward into the cartridge attachment section 110, the ink needle 102 enters into an ink supply port 71 of the ink supply portion 34. The ink needle 102 is thus connected to the ink supply portion 34 to allow communication with each other. Hence, ink stored in a second storage chamber 33 formed in the ink cartridge 30 is allowed to flow into the tank 103 through an ink valve chamber 35 formed in the ink supply portion 34 and an inner space defined in the ink needle 102. Incidentally, the ink needle 102 may have a flat-shaped tip end or a pointed tip end.

<Contacts 106>

As illustrated in FIG. 3, a set of four contacts 106 (only one contact is shown in FIG. 3) is provided for each of the internal space of the cartridge case 101 configured to receive the ink cartridge 30. The set of four contacts 106 is disposed on the top wall of the cartridge case 101. The set of four contacts 106 protrudes downward from the top wall toward the internal space of the cartridge case 101 configured to receive the ink cartridge 30. Although not illustrated in detail in the drawings, the four contacts 106 are arranged to be spaced apart from one another in the left-right direction. Each of the four contacts 106 is arranged at a position corresponding to each one of four electrodes 65 of the ink cartridge 30 as will be described later. Each contact 106 is formed of a material having electrical conductivity and resiliency. The contacts 106 are therefore upwardly resiliently deformable.

In the present embodiment, four sets of the four contacts 106 are disposed corresponding to the four ink cartridges 30 that can be mounted in the cartridge case 101. That is, a total of 16 (sixteen) contacts 106 are disposed at the cartridge case 101. The number of contacts 106 and the number of electrodes 65 may be arbitrary.

Each contact 106 is electrically connected to an arithmetic-logic unit (not shown) via an electrical circuit. The arithmetic-logic unit may include a CPU, a ROM, and a RAM, for example, or may be configured as a controller of the printer 10. When in contact with the corresponding electrodes 65, the contacts 106 are respectively electrically connected to the corresponding electrodes 65, so that a voltage Vc is applied to a first one of the electrodes 65; a second one of the electrodes 65 is grounded; a signal indicative of data is forwarded to a third one of the electrodes 65; and a synchronizing signal is transmitted from the arithmetic-logic unit to a fourth one of the electrodes 65. Due to establishment of the electrical connection between the contacts 106 and the electrodes 65, the data stored in an IC of the ink cartridge 30 is made electrically accessible to the arithmetic-logic unit. Outputs from the contacts 106 through the electrical circuits are configured to be inputted into the arithmetic-logic unit.

<Rod 125>

As illustrated in FIG. 3, each rod 125 is provided at the end wall of the cartridge case 101 at a position above the ink needle 102. Each rod 125 has a hollow cylindrical shape and protrudes rearward from the end wall of the cartridge case 101. In a state where the ink cartridges 30 are attached to the cartridge attachment section 110, that is, when the ink cartridges 30 are in the attachment position, the rods 125 are respectively received in air communication ports 96 (described later) of the corresponding ink cartridges 30.

<Optical Sensor 113>

As illustrated in FIG. 3, the optical sensors 113 are also disposed at the top wall of the cartridge case 101. Each optical sensor 113 is disposed at a position rearward of the corresponding rod 125 but frontward of the set of four contacts 106. Each optical sensor 113 includes a light-emitting element and a light-receiving element. The light-emitting element is arranged to oppose the light-receiving element and is spaced apart from the light-receiving element in the left-right direction. When the ink cartridge 30 has been attached to the cartridge attachment section 110, a light-blocking plate 67 (described later) of the attached ink cartridge 30 is disposed between the light-emitting element and the light-receiving element of the optical sensor 113. In other words, the light-emitting element and the light-receiving element are arranged to oppose each other with the light-blocking plate 67 of the ink cartridge 30 attached to the cartridge attachment section 110 interposed between the light-emitting element and the light-receiving element.

The optical sensor 113 is configured to output different detection signals depending on whether or not light emitted in the left-right direction from the light-emitting element is received by the light-receiving element. For example, the optical sensor 113 outputs a low-level signal when the light emitted from the light-emitting element is not received at the light-receiving element (that is, when an intensity of the light received at the light-receiving element is less than a predetermined intensity). On the other hand, the optical sensor 113 outputs a high-level signal when the light emitted from the light-emitting element is received by the light-receiving element (that is, when the intensity of the received light is equal to or greater than the predetermined intensity).

<Lock Shaft 145>

As illustrated in FIG. 3, a lock shaft 145 is also provided at the cartridge case 101. The lock shaft 145 extends in the left-right direction at a position near the top wall and the opening 112 of the cartridge case 101. The lock shaft 145 is a rod-like member extending in the left-right direction. For example, the lock shaft 145 is a columnar-shaped metal. The lock shaft 145 has both ends that are fixed to walls defining both ends of the cartridge case 101 in the left-right direction. Accordingly, the lock shaft 145 is not movable (for example, is not pivotally movable) relative to the cartridge case 101. The lock shaft 145 extends in the left-right direction across the four spaces respectively corresponding to the four ink cartridges 30. In each of the spaces, a space is provided around the lock shaft 145. Thus, a locking surface 151 (described later) of each ink cartridge 30 can access the lock shaft 145 by moving upward or rearward.

Here, the term "access" may imply either a physical access or physical contact (such as, contact that the lock shaft 145 contacts the lock surface 151), or an optical access (such as, exposure of the light-blocking plate 67 (described later) to light emitted from the optical sensor 113). Alternatively, the term "access" may imply an electrical access (such as, establishment of electrical connection between the electrodes 65 of an IC board 64 (described later) and the contacts 106 to allow a current to flow therebetween when the contacts 106 contact the electrodes 65. Further, the access may be achieved in the up-down direction or in the left-right direction. The access may alternatively be achieved in the front-rear direction.

The lock shaft 145 serves to retain the ink cartridges 30 attached to the cartridge attachment section 110 at the attachment position. When the ink cartridge 30 is inserted into the cartridge attachment section 110 and pivotally moved into its operational posture, the ink cartridge 30 is brought into engagement with the lock shaft 145. Further, the lock shaft 145 holds the ink cartridge 30 at the attachment position in the cartridge attachment section 110 against biasing forces of a coil spring 78 and a coil spring 98 (described later) of the ink cartridge 30 that push the ink cartridge 30 rearward.

<Tank 103>

As illustrated in FIG. 1, each tank 103 is provided at a position frontward of the cartridge case 101. The tank 103 has a box-like shape defining an internal space that allows ink to be stored therein. An atmosphere communication port 124 opened to outside is formed at an upper portion of each tank 103, and therefore the internal space of the tank 103 (an example of a main body side liquid storage chamber) can be opened to the atmosphere through the atmosphere communication port 124. The internal space of the tank 103 has a rear end portion in communication with the inner space of the ink needle 102. With this configuration, ink can flow out from the ink cartridge 30 through the ink needle 102 and is stored in the tank 103. Each tank 103 is connected to the corresponding ink tube 20. Thus, the ink stored in the internal space of each tank 103 is supplied to the recording head 21 through the corresponding ink tube 20.

<Ink Cartridge 30>

The ink cartridge 30 illustrated in FIGS. 4 through 6B is a container configured to store ink therein. The posture of the ink cartridge 30 illustrated in FIGS. 4 to 6B is a posture of the ink cartridge 30 when the ink cartridge 30 is in the operational posture, that is, a posture of the ink cartridge 30 in a state where the ink cartridge 30 is capable of being used in the printer 10. The posture of the ink cartridge 30 illustrated in FIGS. 4 to 6B is also referred to as an "upright posture." The upright posture of the ink cartridge 30 is coincident with an attachment posture of the ink cartridge 30 to the cartridge attachment section 110. When the ink cartridge 30 is attached to the cartridge attachment section 110 to provide the attachment posture, the ink cartridge 30 is capable of supplying ink to the recording head and being operated by the printer 10 for recording images. Note that the "front", "rear", "up", "down", "left" and "right" sides of the ink cartridge 30 implies that the "front", "rear", "up", "down", "left" and "right" sides of the ink cartridge 30 in its upright posture. Further, in the present embodiment, the upright posture of the ink cartridge 30 is coincident with a posture of the ink cartridge 30 when the ink cartridge 30 is inserted into the cartridge attachment section 110 in a direction crossing the gravitational direction, that is, when the ink supply portion 34 of the ink cartridge 30 is directed in a direction perpendicular to the gravitational direction.

The ink cartridge 30 includes a front wall 40, a rear wall 41, a top wall 39, a bottom wall 42, a sub-bottom wall 48, a side wall 37, and a side wall 38. The bottom wall 42 and the sub-bottom wall 48 are an example of a bottom wall. When the ink cartridge 30 is in the operational posture, a direction from the rear wall 41 toward the front wall 40 coincides with the frontward direction 51; a direction from the front wall 40 toward the rear wall 41 coincides with the rearward direction 52; a direction from the top wall 39 toward the bottom wall 42 and the sub-bottom wall 48 coincides with the downward direction 53 (gravitational direction); a direction from the bottom wall 42 and the sub-bottom wall 48 toward the top wall 39 coincides with the upward direction 54; a direction from the side wall 38 toward the side wall 37 coincides with the rightward direction 55, and a direction from the side wall 37 toward the side wall 38 coincides with the leftward direction 56.

When the ink cartridge 30 is attached to the cartridge attachment section 110 in an insertion direction (i.e. frontward direction) perpendicular to the gravitational direction, an outer surface of the front wall 40 faces frontward, an outer surface of the rear surface 41 faces rearward, outer surfaces of the bottom wall 42 and the sub-bottom wall 48 face downward, and an outer surface of the top wall 39 faces upward.

As illustrated in FIGS. 4 through 6B, the ink cartridge 30 includes a cartridge body 31 having a generally rectangular parallelepiped shape. In the present embodiment, the cartridge body 31 is a container formed of a resin.

Figure 7:
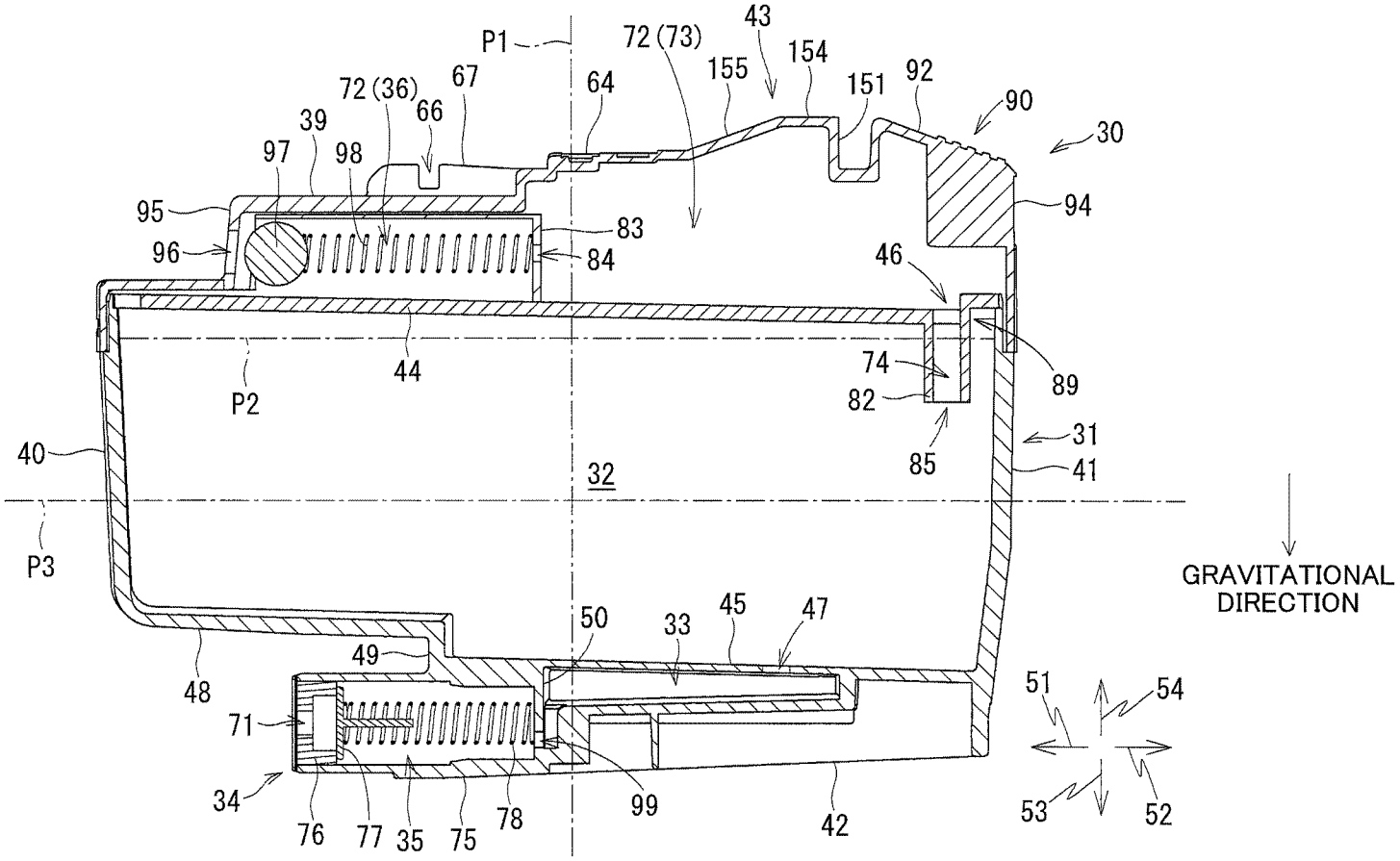
FIG. 7 is a cross-sectional view of the ink cartridge 30 according to the embodiment taken along a line VII-VII in FIG. 6B.

The cartridge body 31 includes the front wall 40, the rear wall 41, the top wall 39, the bottom wall 42, the sub-bottom wall 48, the side wall 37, and the side wall 38. As illustrated in FIG. 7, a first storage chamber 32 and the second storage chamber 33 are formed within the cartridge body 31. The first storage chamber 32 and the second storage chamber 33 are an example of a liquid storage chamber. The cartridge body 31 has a generally flat shape having a height in the up-down direction, a width in the left-right direction, and a length in the front-rear direction, the width being smaller than the height and the length.

When the ink cartridge 30 is inserted into the cartridge attachment section 110, i.e., when the ink cartridge 30 is in the operational posture, a surface of the cartridge body 31 facing frontward (i.e., front surface) is a front surface of the front wall 40, while a surface of the cartridge body 31 facing rearward (i.e., rear surface) is a rear surface of the rear wall 41. In the operational posture of the ink cartridge 30, the front wall 40 and the rear wall 41 are spaced away from each other in the front-rear direction.

The top wall 39 connects an upper end portion of the front wall 40 and an upper end portion of the rear wall 41. The bottom wall 42 extends frontward from a lower end portion of the rear wall 41. The sub-bottom wall 48 extending rearward from a lower end portion of the front wall 40, and is positioned upward relative to the bottom wall 42. The sub-bottom wall 48 has a rear end positioned rearward relative to a front end portion of the ink supply portion 34. A connecting wall 49 is connected to both the bottom wall 42 and the sub-bottom wall 48. The ink supply portion 34 extends frontward from the connecting wall 49 at a position downward relative to the sub-bottom wall 48 and upward relative to the bottom wall 42. Accordingly, the bottom wall 42 and the sub-bottom wall 48 connect the lower end portion of the front wall 40 and the lower end portion of the rear wall 41.

The side wall 37 and the side wall 38 extend to intersect with the front wall 40 and the rear wall 41 so as to connect the front wall 40 and the rear wall 41. In the operational posture of the ink cartridge 30, an outer surface of the side wall 37 faces rightward, and an outer surface of the side wall 38 faces leftward.

In the cartridge body 31, at least the rear wall 41 has translucency allowing liquid surface of ink stored in the first storage chamber 32 and the second storage chamber 33 to be visible from outside.

Figure 6B:
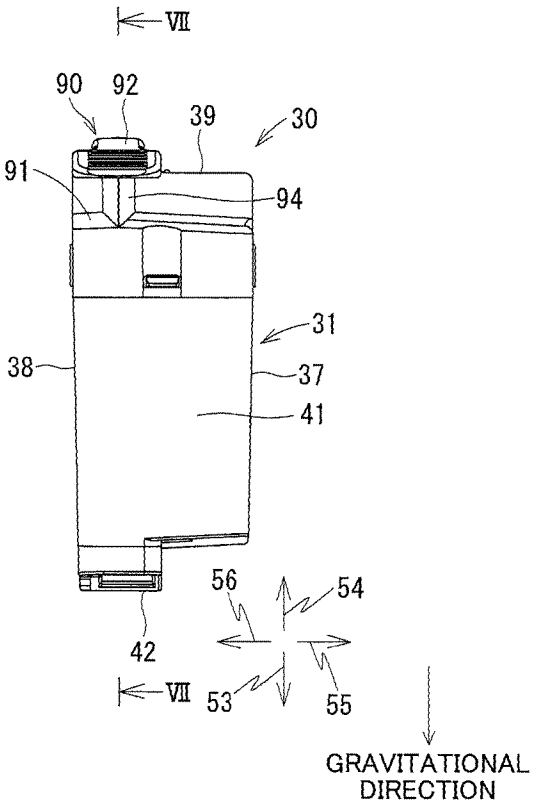
FIG. 6B is a rear view of the ink cartridge 30 according to the embodiment.
Figure 6A:
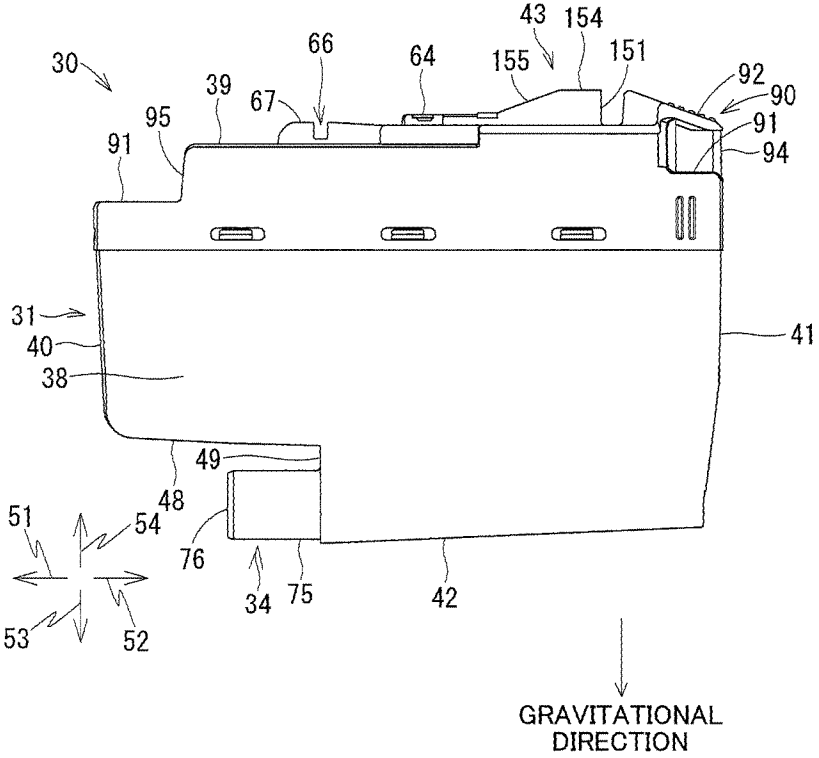
FIG. 6A is a left side view of the ink cartridge 30 according to the embodiment.

As illustrated in FIG. 6A, a bottom surface of the bottom wall 42 is sloped relative to the front-rear direction such that a front end of the bottom surface of the bottom wall 42 is positioned downward of the rear end of the bottom surface of the bottom wall 42. The front end of the bottom surface of the bottom wall 42 is positioned frontward of the locking surface 151 described later.

As illustrated in FIGS. 4 through 6B, a protrusion 43 is provided on the top wall 39 of the cartridge body 31. The protrusion 43 extends in the front-rear direction at a position leftward of the center portion of the top wall 39 in the left-right direction. The protrusion 43 has a rear end whose surface faces rearward. This surface serves as the locking surface 151. The locking surface 151 is positioned upward relative to the top surface 39 of the cartridge body 31. The locking surface 151 extends in the up-down direction. In a state where the ink cartridge 30 is attached to the cartridge attachment section 110, the locking surface 151 facing rearward is in contact with the lock shaft 145 from frontward thereof. The contact between the locking surface 151 and the lock shaft 145 in the front-rear direction enables the ink cartridge 30 to be held in the cartridge attachment section 110 against the biasing force of the coil spring 78.

The protrusion 43 also includes a horizontal surface 154 and an inclined surface 155. The horizontal surface 154 extends frontward from an upper edge of the locking surface 151. That is, the horizontal surface 154 is provided frontward of the locking surface 151 and continuous with the locking surface 151. The horizontal surface 154 extends in the front-rear direction and in the left-right direction. The inclined surface 155 extends diagonally frontward and downward from a front edge of the horizontal surface 154. That is, the inclined surface 155 is disposed frontward of the horizontal surface 154 and continuous with the horizontal direction 154. The inclined surface 155 faces upward and frontward. The inclined surface 155 is disposed such that a front end of the inclined surface 155 is positioned downward of a rear end of the inclined surface 155. The locking surface 151 and the inclined surface 155 are connected to each other via the horizontal surface 154. Thus, a boundary between the locking surface 151 and inclined surface 155 does not constitute a ridge-like shape. With this configuration, during insertion of the ink cartridge 30 into the cartridge attachment section 110, the lock shaft 145 is smoothly guided toward the rear beyond the locking surface 151 while abutting against and sliding along the inclined surface 155 and horizontal surface 154.

An operation portion 90 is formed on the top wall 39 of the cartridge body 31 at a position rearward of the lock surface 151. Sub-upper surfaces 91 (front-side sub-upper surface and rear-side sub-upper surface) are formed frontward of and rearward of the top wall 39 of the cartridge body 31, respectively, so as to be positioned downward of the outer surface of the top wall 39 positioned at the center portion of the top wall 39 in the front-rear direction. The operation portion 90 is disposed upward of the rear-side sub-upper surface 91 with a space therebetween. The operation portion 90 has a flat plate-like shape protruding upward from the boundary between the top wall 39 and the rear-side sub-upper surface 91 such that an upper end of the operation portion 90 is disposed at a position approximately the same as that of the protrusion 43 in the up-down direction. The upper end of the operation portion 90 is positioned frontward of a lower end of the operation portion 90. A rib 94 is provided between the operation portion 90 and the rear-side sub-upper surface 91. The rib 94 is continuous with the operation portion 90 and the rear-side sub-upper surface 91, and extends rearward. The rib 94 has a dimension in the left-right direction smaller than those of the operation portion 90 and the rear-side sub-upper surface 91 in the left-right direction. With this configuration, the rib 94 can suppress deformation of a rear portion of the operation portion 90 in the up-down direction.

The operation portion 90 has an operation surface 92 facing upward and rearward. The operation surface 92 has a rear end portion aligned with the rear-side sub-upper surface 91 in the up-down direction. In other words, the rear end portion of the operation surface 92 and the rear-side sub-upper surface 91 are arranged to be overlapped with each other when the ink cartridge 30 is viewed from above.

In the operation surface 92, a plurality of projections, for example, a plurality of projecting ribs 93 extending in the left-right direction are formed to be spaced apart from one another in the front-rear direction. The projecting ribs 93 as a plurality of projections allow the user to easily recognize the operation surface 92. The projecting ribs 93 can also serve to prevent the user's finger from slipping over the operation surface 92 when the user operates the operation surface 92.

The operation surface 92 is visible when the ink cartridge 30 is viewed from upward and from rearward. The user operates the operation surface 92 in order to remove the ink cartridge 30 attached to the cartridge attachment section 110 therefrom. Incidentally, the operation portion 90 is formed integrally with the cartridge body 31. Accordingly, the operation portion 90 is fixed to the cartridge body 31 so as not to move (for example, pivotally move) relative to the cartridge body 31. Thus, a force applied from the user to the operation surface 92 is directly transmitted to the cartridge body 31 without changing a direction of the force.

Incidentally, each outer surface of the front wall 40, the rear wall 41, the top wall 39, the bottom wall 42, the side wall 37 and the side wall 38 constituting the ink cartridge 30 need not be configured as one flat plane, respectively. That is, the front surface (i.e. the outer surface of the front wall) of the ink cartridge 30 can be any surface(s) that is visible when the ink cartridge 30 in its operational posture is viewed from its front side and that is positioned frontward relative to a front-rear center of the ink cartridge 30 in its operational state. The rear surface (i.e. the outer surface of the rear wall) of the ink cartridge 30 can be any surface(s) that is visible when the ink cartridge 30 in its operational posture is viewed from its rear side and that is positioned rearward relative to the front-rear center of the ink cartridge 30. The top surface (i.e. the outer surface of the top wall) of the ink cartridge 30 can be any surface(s) that is visible when the ink cartridge 30 in its operational posture is viewed from above and that is positioned upward relative to an up-down (vertical) center of the ink cartridge 30. The bottom surface (i.e. the outer surface of the bottom wall) of the ink cartridge 30 can be any surface(s) that is visible when the ink cartridge 30 in its operational posture is viewed from below and that is positioned downward relative to the up-down center of the ink cartridge 30. The same is applied to the right surface (i.e. the outer surface of the right side wall) of the ink cartridge 30 and the left surface (i.e. the outer surface of the left side wall) of the ink cartridge 30. The right surface of the ink cartridge 30 can be any surface(s) that is visible when the ink cartridge 30 in its operational posture is viewed from its right side and that is positioned rightward relative to a left-right center of the ink cartridge 30. The left surface of the ink cartridge 30 can be any surface(s) that is visible when the ink cartridge 30 in its operational posture is viewed from its left side and that is positioned leftward relative to the left-right center of the ink cartridge 30.

As illustrated in FIGS. 4 through 6B, the outer surface of the top wall 39 is formed with the light-blocking plate 67 protruding upward therefrom. The light-blocking plate 67 is positioned frontward relative to the protrusion 43. Further, the light-blocking plate 67 is positioned frontward relative to the IC board 64 described later.

The light-blocking plate 67 is configured to block the light of the optical sensor 113 traveling in the left-right direction. More specifically, during insertion of the ink cartridge 30 to the cartridge attachment section 110, the light emitted from the light-emitting element of the optical sensor 113 is incident on the light-blocking plate 67 before arriving at the light-receiving element. As a result, the intensity of light received at the light-receiving element is less than a predetermined intensity, for example, zero. Note that the light-blocking plate 67 may completely block the light traveling in the left-right direction, or may partially attenuate the light, may refract the light to change a traveling direction thereof, or may fully reflect the light.

Further, the light-blocking plate 67 is formed with a cutout 66. The cutout 66 is recessed downward from an upper surface of the light-blocking plate 67, and extends in the front-rear direction. In a state where the ink cartridge 30 is attached to the cartridge attachment section 110, the cutout 66 is positioned so as to be interposed between the light-emitting element and the light-receiving element of the optical sensor 113. With this configuration, the light emitted from the light-emitting element of the optical sensor 113 is incident on the light-receiving element of the optical sensor 113. The light-blocking plate 67 may not be formed with the cutout 66. Depending on types of the ink cartridge 30, the light-blocking plate 67 may or may not have the cutout 66. Specifically, the types of the ink cartridge 30 imply that types of ink (pigment ink or dye ink) stored in the ink cartridge 30 and initial amounts of ink (large amount or small amount) stored in the ink cartridge 30, for example. The printer 10 can determine the type of the ink cartridge 30 attached to the cartridge attachment section 110 based on the presence or absence of the cutout 66. The user also may determine the type of the ink cartridge 30 based on the presence or absence of the cutout 66.

As illustrated in FIGS. 4 through 6B, the IC board 64 is disposed at the outer surface of the top wall 39 at a position between the light-blocking plate 67 and the protrusion 43 in the front-rear direction. The IC board 64 are electrically connected to the four contacts 106 arranged in the left-right direction during insertion of the ink cartridge 30 into the cartridge attachment section 110, as well as when the ink cartridge 30 is attached to the cartridge attachment section 110.

The IC board 64 includes a circuit board, an IC (not illustrated), and the four electrodes 65. The IC is supported to the circuit board. The four electrodes 65 are formed on the IC board 64, and are electrically connected to the IC. Each of the four electrodes 65 extends in the front-rear direction. The four electrodes 65 are arranged to be spaced apart from each other in the left-right direction on the IC board 64 such that the four electrodes 65 are made electrically accessible, thereby enabling directly contacting the corresponding contacts 106 of the cartridge case 101. The IC is an integrated circuit and readably stores data indicating information on the ink cartridge 30, such as a lot number, a production date, and a color of the ink. Note that the circuit board may be a rigid board, or may be a flexible substrate having flexibility.

A connecting wall 95 extends upward from the rear end of the front-side sub-upper surface 91. The connecting wall 95 faces frontward, and formed with the air communication port 96 (an example of an external opening). In the process of attachment of the ink cartridge 30 to the cartridge attachment section 110, the rod 125 enters the air communication port 96. The rod 125 entering the air communication port 96 moves a valve 97 that seals the air communication port 96 rearward against the biasing force of the coil spring 98. Then, the valve 97 is separated from the air communication port 96, whereby the first storage chamber 32 is opened to the atmosphere.

<Internal Configuration of Cartridge Body 31>

As illustrated in FIG. 7, the first storage chamber 32, the second storage chamber 33, the ink valve chamber 35, and an air communication passage 72 are formed inside the cartridge body 31. Further, the cartridge body 31 includes a partition wall 44 (an example of a top wall) for partitioning the first storage chamber 32 and the air communication passage 72, and a partition wall 45 for partitioning the first storage chamber 32 and the second storage chamber 33. Each of the partition wall 44 and the partition wall 45 extends in the front-rear direction and the left-right direction. The partition wall 44 and the partition wall 45 are disposed to oppose each other in the up-down direction.

The first storage chamber 32 has an upper end defined by a lower surface of the partition wall 44, and a lower end defined by an upper surface of the partition wall 45 and an upper surface of the sub-bottom wall 48. Further, the first storage chamber 32 has a front end defined by an inner surface of the front wall 40, and a rear end defined by an inner surface of the rear wall 41. Both side ends of the first storage chamber 32 are defined by inner surfaces of the side wall 37 and the side wall 38, respectively. That is, the first storage chamber 32 is a space defined by the lower surface of the partition wall 44, the upper surfaces of the partition wall 45 and the sub-bottom wall 48, the inner surface of the front wall 40, the inner surface of the rear wall 41, and the inner surfaces of the side wall 37 and the side wall 38. The first storage chamber 32 has a dimension in the front-rear direction greater than a dimension of the first storage chamber 32 in the left-right direction. At the time of manufacturing of the ink cartridge 30, ink stored in the first storage chamber 32 contacts the upper surface of the partition wall 45, the upper surface of the sub-bottom wall 48, the inner surface of the front wall 40, the inner surface of the rear wall 41, and the inner surfaces of the side wall 37 and the side wall 38.

In the operational posture of the ink cartridge 30, the second storage chamber 33 is positioned downward of the first storage chamber 32 inside the cartridge body 31. The second storage chamber 33 can store ink therein. The second storage chamber 33 has a smaller capacity than that of the first storage chamber 32. That is, a smaller amount of ink can be stored in the second storage chamber 33 than in the first storage chamber 32.

The second storage chamber 33 has an upper end defined by a lower surface of the partition wall 45, and a lower end defined by an upper surface of the bottom wall 42. Further, the second storage chamber 33 has a rear end defined by the inner surface of the rear wall 41. Both side ends of the second storage chamber 33 are defined by the inner surfaces of the side wall 37 and the side wall 38. A partition wall 50 is formed between the second storage chamber 33 and the ink valve chamber 35. The partition wall 50 has a rear surface (surface closer to the second storage chamber 33) defining a front end of the second storage chamber 33. That is, the second storage chamber 33 is a space defined by the lower surface of the partition wall 45, the upper surface of the bottom wall 42, the inner surface of the rear wall 41, the inner surfaces of the side wall 37 and the side wall 38, and the rear surface of the partition wall 50. The second storage chamber 33 has a dimension in the front-rear direction greater than that of the second storage chamber 33 in the left-right direction. At the time of manufacturing of the ink cartridge 30, ink stored in the second storage chamber 33 contacts the lower surface of the partition wall 45, the upper surface of the bottom wall 42, the inner surface of the rear wall 41, the inner surfaces of the side wall 37 and the side wall 38, and the rear surface of the partition wall 50. The second storage chamber 33 is in communication with the first storage chamber 32 through a communication port 47 formed in the partition wall 45. The second storage chamber 33 is in communication with the ink valve chamber 35 through a through hole 99 formed in the partition wall 50.

A maximum amount of ink that can be stored is specified for each of the first storage chamber 32 and the second storage chamber 33. In the present embodiment, in a state where the ink cartridge 30 is in the operational posture and specified maximum amount of ink is stored in each of the first storage chamber 32 and the second storage chamber 33, a liquid surface level of ink stored in the first storage chamber 32 in the up-down direction is represented by a position P2 (an example of a highest liquid level) illustrated in FIG. 7.

Incidentally, the liquid surface level of ink stored in the first storage chamber 32 in a state where the specified maximum amount of ink is stored in each of the first storage chamber 32 and the second storage chamber 33 may not necessarily be equal to a position represented by the position P2. For example, when the specified maximum amount of ink is stored in each of the first storage chamber 32 and the second storage chamber 33, the liquid surface of ink stored in the first storage chamber 32 may contact the lower surface of the partition wall 44.

The air communication passage 72 is configured to communicate the first storage chamber 32 with the outside of the ink cartridge 30 so that the first storage chamber 32 can be communicated with the atmosphere. As illustrated in FIG. 3, the air communication passage 72 includes an air chamber 73, an air valve chamber 36, and an inner space 74 of an air communication pipe 82. The air chamber 73 and the air valve chamber 36 are an example of a buffer chamber.

The air chamber 73 and the air valve chamber 36 are positioned upward relative to the partition wall 44.

The air chamber 73 has a lower end defined by an upper surface of the partition wall 44. That is, the upper surface of the partition wall 44 serves to a bottom surface of the air chamber 73. Further, an upper end of the air chamber 73 is defined by a lower surface of the top wall 39, and both side ends of the air chamber 73 are defined by the inner surfaces of the side wall 37 and side wall 38. The partition wall 44 has a rear end portion formed with a through hole 46 (an example of a liquid storage chamber side opening), and the air chamber 73 is communicated with the inner space 74 of the air communication pipe 82 via the through hole 46. Here, the inner space 74 of the air communication pipe 82 is communicated with the first storage chamber 32. Accordingly, the air chamber 73 is communicated with the first storage chamber 32 through the through hole 46. The upper surface of the partition wall 44 is sloped relative to the front-rear direction so as to be sloped downward toward the through hole 46.

The cartridge body 31 further includes a partition wall 83 that partitions the air valve chamber 36 and the air chamber 73. The air valve chamber 36 is a space defined by a front surface of the partition wall 83, the upper surface of the partition wall 44, a rear surface of the connecting wall 95, and the inner surfaces of the side wall 37 and the side wall 38. The partition wall 83 is formed with a through hole 84, and the air valve chamber 36 is in communication with the air chamber 73 through the through hole 84. The air valve chamber 36 is in communication with the atmosphere through the air communication port 96 penetrating the connecting wall 95.

The valve 97 and the coil spring 98 are accommodated in the air valve chamber 36. The valve 97 is movable between a closing position (see FIG. 7) closing the air communication port 96 and an opening position (see FIG. 3) separated from the air communication port 96. The coil spring 98 is disposed so as to be capable of expanding and contracting in the front-rear direction. When no external force is applied, the coil spring 98 is configured to urge the valve 97 in a direction in which the valve 97 abuts against the air communication port 96, i.e., frontward.

A center position P1 is defined as a front-rear center position of the first storage chamber 32 and the second storage chamber 33. Here, a space constituted by the air chamber 73 and the air valve chamber 36 has a front end (i.e., a front end of the air valve chamber 36) positioned frontward relative to the center position P1 in the front-rear direction. In other words, in the present embodiment, the front end of the air valve chamber 36 is positioned closer to the front end of the first storage chamber 32 (i.e., the front wall 40) than to the rear end of the first storage chamber 32 (i.e., the rear wall 41) in the front-rear direction.

On the other hand, the space defined by the air chamber 73 and the air valve chamber 36 has a rear end (i.e., a rear end of the air chamber 73) positioned rearward relative to the center position P1 in the front-rear direction. In other words, in the present embodiment, the rear end of the air chamber 73 is positioned closer to the rear end of the first storage chamber 32 (i.e., the rear wall 41) than to the front end of the first storage chamber 32 (i.e., the front wall 40) in the front-rear direction. That is, the space constituted by the air chamber 73 and the air valve chamber 36 is formed at a region between a position closer to the front wall 40 than the center position P1 is to the front wall 40 in the front-rear direction and a position closer to the rear wall 41 than the center position P1 to the rear wall 41 in the front-rear direction.

Note that a semipermeable membrane may be disposed in the air chamber 73 or the air valve chamber 36 so that a portion between the through hole 46 and the air communication port 96 is closed. For example, the semipermeable membrane may be welded to the through hole 84 so as to close the through hole 84. The semipermeable membrane is a porous membrane having minute holes configured to prevent ink from passing therethrough but to allow air to pass therethrough. For example, the semipermeable membrane is made of a fluorine resin such as polytetrafluoroethylene, polychlorotrifluoroethylene, tetrafluoroethylene-hexafluoropropylene copolymer, tetrafluoroethylene-perfluoroalkylvinylether copolymer, or tetrafluoroethylene-ethylene copolymer.

The air communication pipe 82 extends downward from the lower surface of the partition wall 44 into the first storage chamber 32. That is, the air communication pipe 82 is disposed at a position not higher than the upper surface of the partition wall 44.

In the present embodiment, the air communication pipe 82 has a hollow cylindrical shape. However, the air communication pipe 82 may have a shape other than a hollow cylindrical. For example, the air communication pipe 82 may be a hollow square columnar shaped. Further, the air communication pipe 82 extends from the partition wall 44, but a different configuration may be employed. For example, the air communication pipe 82 may be a hollow tube formed of a flexible material and may extend through the partition wall 44 in the up-down direction.

The air communication pipe 82 is formed so as to surround the through hole 46 when the partition wall 44 is viewed from below. Specifically, the through hole 46 is formed adjacent to an upper end of the inner space 74 to be communicated with the inner space 74 of the air communication pipe 82. That is, the inner space 74 of the air communication pipe 82 is communicated with the air chamber 73 through the through hole 46. The air communication pipe 82 has an upper end formed with an opening 89 (an example of another end opening), and a lower end formed with an opening 85 (an example of one end opening) in communication with the first storage chamber 32. As described above, the air valve chamber 36 is communicated with the atmosphere through the air communication port 96. That is, the air communication passage 72 has one end opened in the first storage chamber 32 through the opening 85 of the air communication pipe 82, while the air communication passage 72 has another end open to the atmosphere through the air communication port 96.

The air communication pipe 82 is positioned at a rear end portion of the first storage chamber 32, that is, adjacent to the rear wall 41 in the first storage chamber 32. The lower end of the air communication pipe 82 defining the opening 85 is positioned downward relative to the position P2 and upward relative to a center position P3. The center position P3 is an up-down center position of the first storage chamber 32 and the second storage chamber 33. In other words, in the up-down direction, a distance between the upper end of the first storage chamber 32 and the center position P3 is the same as a distance between the lower end of the second storage chamber 33 and the center position P3.

Figure 8:
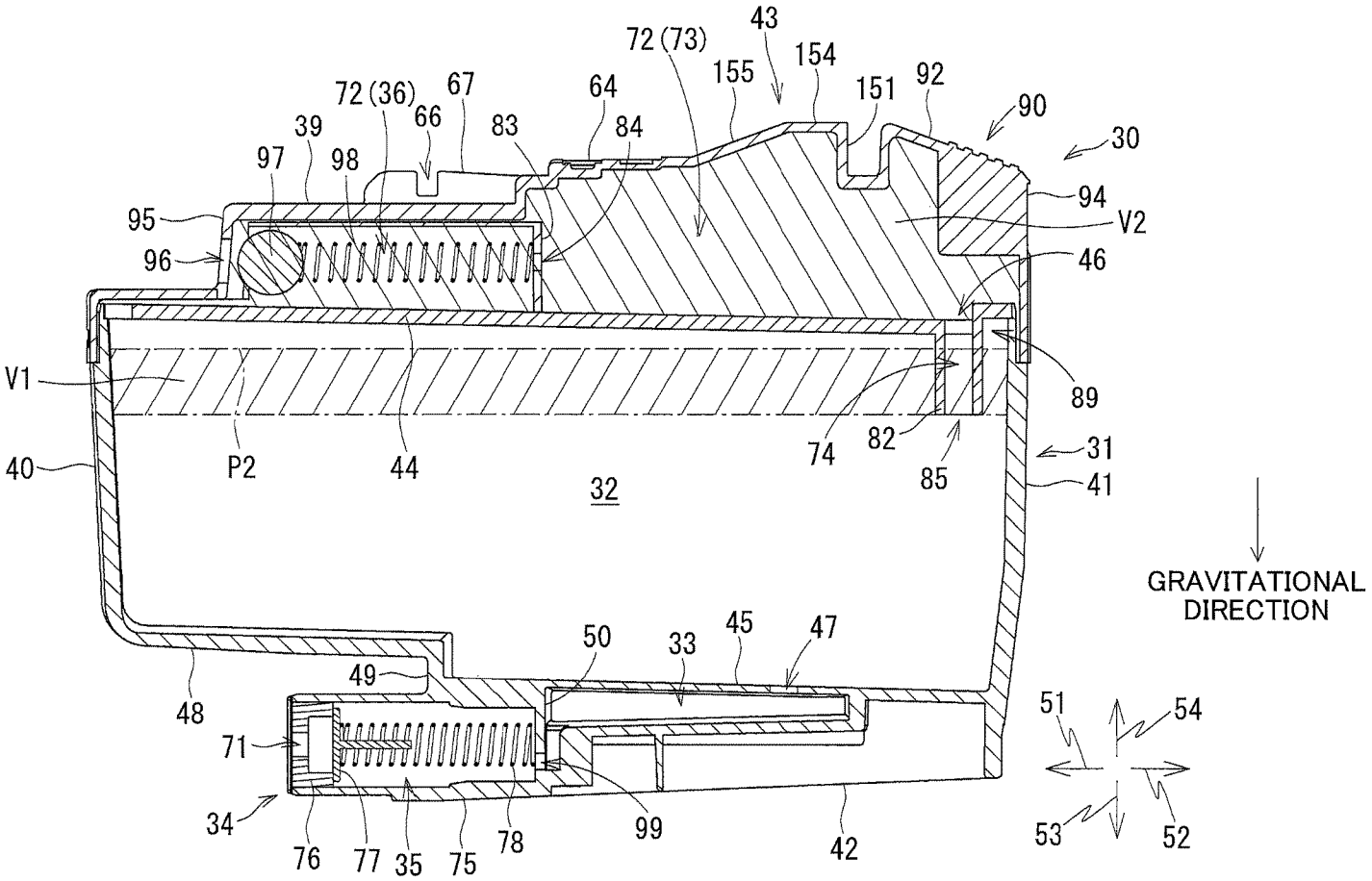
FIG. 8 is a cross-sectional view of the ink cartridge 30 according to the embodiment taken along the line VII-VII in FIG. 6B.

As illustrated in FIG. 8, the first storage chamber 32 has a partial internal volume V1 (space indicated by a hatching in FIG. 8). The partial internal volume V1 is defined at a region upward of the opening 85 and downward of the position P2 in the up-down direction. In other words, the partial internal volume V1 is defined at a region between an imaginary horizontal plane containing the opening 85 and the position P2. The space constituted by the air chamber 73 and the air valve chamber 36 has an internal volume V2 (space indicated by another hatching in FIG. 8). The partial internal volume V1 of the first storage chamber 32 is smaller than the internal volume V2 of the space constituted by the air chamber 73 and the air valve chamber 36.

The inner space of the tank 103 (see FIG. 1) has a volume greater than the internal volume V2 of the space constituted by the air chamber 73 and the air valve chamber 36.

The ink supply portion 34 (an example of a liquid supply portion) serves to supply ink stored in the first storage chamber 32 and the second storage chamber 33 from the ink valve chamber 35 to the outside of the ink cartridge 30 (in the present embodiment, the inner space of the ink needle 102) through the ink supply port 71.

The ink supply portion 34 has an outer shape that is hollow cylindrical. More specifically, the ink supply portion 34 includes a cylinder 75 whose front end is open, and a packing 76. The cylinder 75 protrudes frontward relative to the connecting wall 49. The cylinder 75 defines an inner space serving as the ink valve chamber 35. The front end of the cylinder 75 is open to the outside of the ink cartridge 30. The packing 76 is attached to the front end of the cylinder 75.

A valve 77 and the coil spring 78 are accommodated in the ink valve chamber 35. The valve 77 is movable in the front-rear direction to open and close the ink supply port 71 extending through a center portion of the packing 76. The coil spring 78 biases the valve 77 frontward. Accordingly, in a state that no external force is applied, the valve 77 closes the ink supply port 71 of the packing 76.

The packing 76 is a disc-like shaped and has a center portion in which a through-hole is formed. The packing 76 is formed of an elastic material such as rubber or elastomer, for example. The through-hole penetrates through the center portion of the packing 76 in the front-rear direction to provide a tubular-shaped inner circumferential surface that defines the ink supply port 71. The ink supply port 71 has an inner diameter that is slightly smaller than an outer diameter of the ink needle 102.

When the ink cartridge 30 is inserted into the cartridge attachment section 110 in a state where the valve 77 closes the ink supply port 71, the ink needle 102 enters into the ink supply port 71. An outer circumferential surface of the ink needle 102 is brought into contact with the inner circumferential surface of the packing 76 defining the ink supply port 71 to provide a liquid-tight seal therewith, while elastically deforming the packing 76. When the tip end of the ink needle 102 moves past the ink supply port 71 defined in the packing 76 and enters into the ink valve chamber 35, the tip end of the ink needle 102 comes in contact with the valve 77. As the ink cartridge 30 is further inserted into the cartridge attachment section 110, the ink needle 102 moves the valve 77 rearward against a biasing force of the coil spring 78, thereby opening the ink supply port 71. Accordingly, ink stored in the ink valve chamber 35 can flow into the inner space of the ink needle 102.

<One Example of Injecting Operation of Ink into Ink Cartridge 30>

Hereinafter, one example of injecting operation for injecting ink into the first storage chamber 32, the second storage chamber 33, and the ink valve chamber 35 during manufacture of the ink cartridge 30 will be described.

Figure 9:
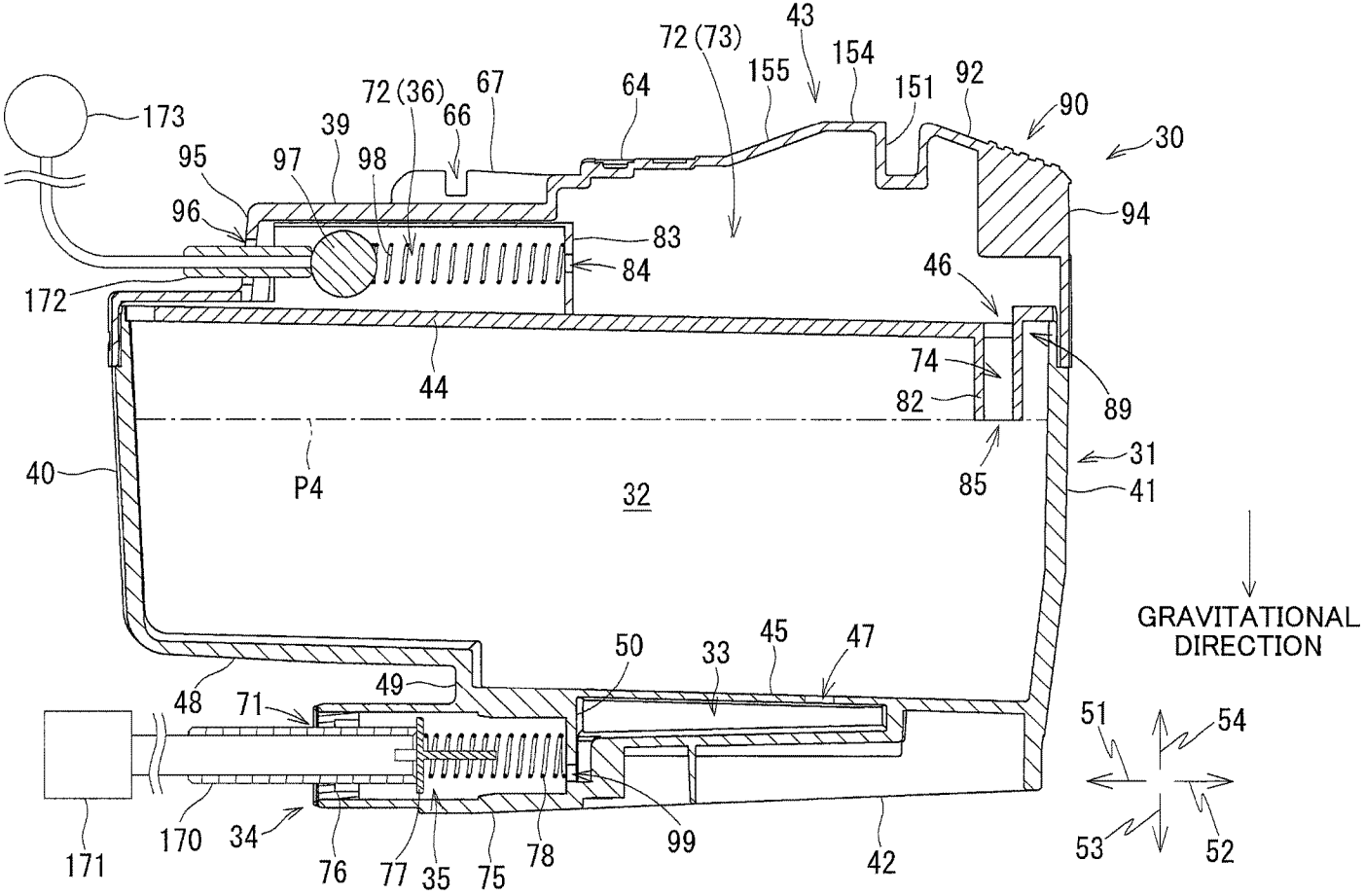
FIG. 9 is a cross-sectional view of the ink cartridge 30 according to the embodiment taken along the line VII-VII in FIG. 6B, and illustrating a state in which a casing 171 and a pump 173 are connected to the ink cartridge 30.

First, as illustrated in FIG. 9, an ink needle 170 is inserted into the ink supply port 71 of the ink cartridge 30 in which no ink is stored in the first storage chamber 32, the second storage chamber 33 and the ink valve chamber 35. The ink needle 170 described here differs from the above-described ink needle 102 that is provided in the cartridge case 101. The ink needle 170 has one end adapted to be inserted into the ink supply port 71, and another end in communication with a casing 171 (such as, an ink bottle storing ink therein) through a tube. The ink needle 170 is inserted into the ink supply port 71 to move the valve 77 rearward against the biasing force of the coil spring 78, thereby allowing ink stored in the casing 171 to flow into the ink valve chamber 35, the second storage chamber 33, and the first storage chamber 32.

In this way, when ink is injected to the first storage chamber 32, the second storage chamber 33 and the ink valve chamber 35 during manufacturing of the ink cartridge 30, the ink supply portion 34 is used as an injection port for injecting ink from outside of the ink cartridge 30 (i.e., the casing 171 such an ink bottle) to the first storage chamber 32 and the second storage chamber 33.

Next, a pressure reducing valve 172 is connected to the air communication port 96. The pressure reducing valve 172 has one end adapted to be inserted into the air communication port 96, and another end connected to a pump 173. The one end of the pressure reducing valve 172 is inserted into the air communication port 96 to move the valve 97 rearward against the biasing force of the coil spring 98. Then, the valve 97 is moved rearward to separate from the air communication port 96, and thus the first storage chamber 32, the second storage chamber 33 and the ink valve chamber 35 is brought into communication with an inner space of the pressure reducing valve 172 through the inner space 74 of the air communication pipe 82, the air chamber 73, and the air valve chamber 36.

Next, the pump 173 is driven, thereby reducing the atmospheric pressure inside the first storage chamber 32, the second storage chamber 33 and the ink valve chamber 35. Accordingly, ink stored in the casing 171 is sucked into the ink valve chamber 35, then the ink flows into the second storage chamber 33 and the first storage chamber 32 through the ink valve chamber 35.

Figure 10:
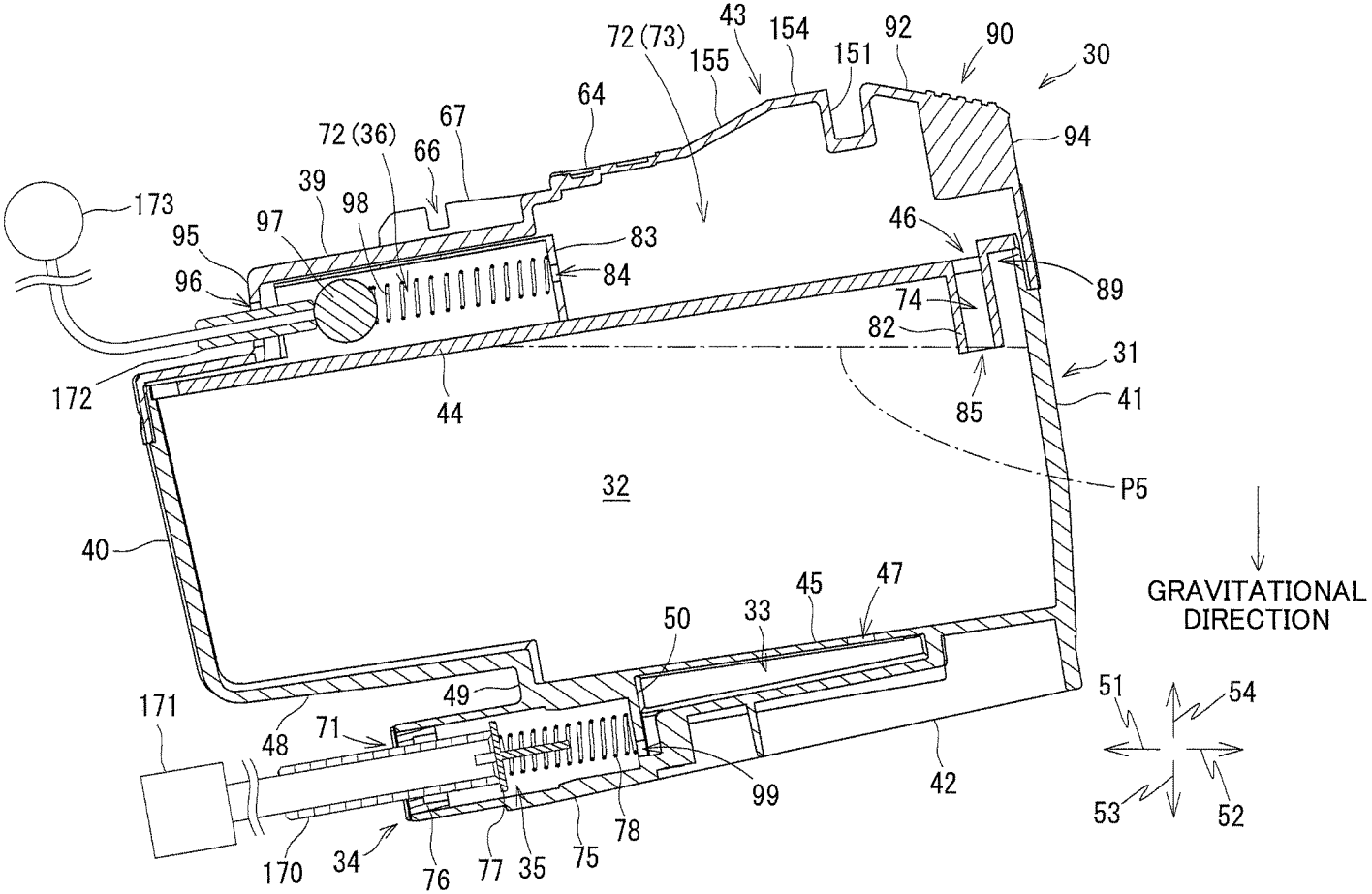
FIG. 10 is a cross-sectional view of the ink cartridge 30 taken along the line VII-VII in FIG. 6B, and illustrating a state in which the casing 171 and the pump 173 are connected to the ink cartridge 30 and the ink cartridge 30 is moved to be inclined.

When liquid surface of the ink reaches the lower end of the air communication pipe 82 (i.e., the opening 85) during injection of the ink, no further injection of the ink can be performed. For example, assuming that ink is injected into the ink cartridge 30 in a posture illustrated in FIG. 9, further injection of the ink cannot be performed after the liquid surface of the ink reaches a position P4 in the first storage chamber 32. The position of the position P4 in the up-down direction is the same as the position of the opening 85 in the up-down direction. Thus, after the liquid surface of the ink reaches the position P4 during injection of the ink, the ink cartridge 30 is moved to be inclined such that a rear end of the ink cartridge 30 is positioned upward relative to a front end of the ink cartridge 30, as illustrated in FIG. 10. This movement allows ink to be injected into the ink cartridge 30 again until the liquid surface of ink reaches a position P5 in the up-down direction, i.e., until the liquid surface of ink reaches the opening 85 of the inclined ink cartridge 30. In this way, a larger amount of ink can be injected into the first storage chamber 32, the second storage chamber 33 and the ink valve chamber 35 in comparison with a case where the ink cartridge 30 is not moved to be inclined during injection of ink.

<Variations and Modifications>

In the above-described embodiment, the air communication pipe 82 is positioned at the rear end portion of the first storage chamber 32 in the front-rear direction. However, the air communication pipe 82 may be positioned at a different portion in the first storage chamber 32 as long as the air communication pipe 82 is positioned upward relative to the center position P3 in the first storage chamber 32. For example, the air communication pipe 82 may be disposed at any portion within the area rearward relative to the center position P1 illustrated in FIG. 7 and upward relative to the center position P3 illustrated in FIG. 7. Alternatively, the air communication pipe 82 may be disposed at any position within the area frontward relative to the center position P1 illustrated in FIG. 7 and upward relative to the center position P3 illustrated in FIG. 7.

In the above-described embodiment, the air communication pipe 82 extends from the partition wall 44. However, the air communication pipe 82 may extend from a wall other than the partition wall 44. Further, in the above-described embodiment, the through hole 46 is formed at the partition wall 44, but may be formed at a different wall in the ink cartridge 30. For example, the through hole 46 may be formed at the side wall 37, and may be bent (curved) so as to extend from the side wall 37 toward the first storage chamber 32. In this case, the upper end of the air communication pipe 82 is positioned upward relative to the upper surface of the partition wall 44.

In the above-described embodiment, the upper surface of the partition wall 44 is sloped downward toward the through hole 46. However, the upper surface of the partition wall 44 need not necessarily be sloped.

In the above-described embodiment, the space constituted by the air chamber 73 and the air valve chamber 36 is provided at the region from the position closer to the front wall 40 than the center position P1 is to the front wall 40 in the front-rear direction to the position closer to the rear wall 41 than the center position P1 is to the rear wall 41 in the front-rear direction. However, an area where the air chamber 73 and the air valve chamber 36 are provided is not limited to the region described in the above-described embodiment. For example, the air chamber 73 and the air valve chamber 36 may be formed only at a region closer to the front wall 40 than the center position P1 is to the front wall 40 in the front-rear direction, or may be formed only at a region closer to the rear wall 41 than the center position P1 is to the rear wall 41 in the front-rear direction.

In the above-described embodiment, the air chamber 73 and the air valve chamber 36 are provided at a position upward relative to the partition wall 44, but the air chamber 73 and the air valve chamber 36 may be provided at different positions. For example, the air chamber 73 and the air valve chamber 36 may be positioned frontward relative to the front wall 40, or may be positioned rightward relative to the side wall 37.

In the above-described embodiment, the air chamber 73 and the air valve chamber 36 are formed between the air communication pipe 82 and the outside of the ink cartridge 30. However, the air chamber 73 and the air valve chamber 36 need not necessarily be formed in the ink cartridge 30. In this case, the one end (i.e., the opening 85) of the air communication pipe 82 is in communication with the first storage chamber 32, and the other end (i.e., the opening 89) of the air communication pipe 82 is in communication with the outside of the ink cartridge 30.

In the above-described embodiment, the partial internal volume V1 (space indicated by the hatching illustrated in FIG. 8) defined between the opening 85 of the air communication pipe 82 and the position P2 in the up-down direction is smaller than the internal volume V2 (space indicated by the other hatching illustrated in FIG. 8) of the space constituted by the air chamber 73 and the air valve chamber 36. However, the partial internal volume V1 may be greater than or equal to the internal volume V2.

In the above-described embodiment, the volume of the inner space of the tank 103 (see FIG. 1) is greater than the internal volume V2. However, the volume of the inner space of the tank 103 (see FIG. 1) may be smaller than or equal to the internal volume V2.

In the above-described embodiment, the ink supply portion 34 protrudes frontward from the connecting wall 49. However, the ink supply portion 34 may be provided at a position other than the connecting wall 49. For example, the ink supply portion 34 may protrude downward from the bottom wall 42, or may protrude frontward from the front wall 40. Further, the ink supply portion 34 need not protrude from the wall constituting the ink cartridge 30. For example, the ink supply port 71 may be opened at the connecting wall 49, and the ink valve chamber 35 may be positioned rearward relative to the connecting wall 49 inside the ink cartridge 30.

In the above-described embodiment, the ink supply portion 34 is used as an injection port for injecting liquid from the outside of the ink cartridge 30 into the first storage chamber 32 and the second storage chamber 33. However, a different configuration for injecting liquid into the ink cartridge 30 may be employed. For example, an opening may be formed in the ink cartridge 30 separately from the ink supply port 71 of the ink supply portion 34, and the opening may be used as an injection port for injecting liquid into the ink cartridge 30.

In the above-described embodiment, the cartridge attachment section 110 is provided with the tank 103. However, the cartridge attachment section 110 need not be provided with the tank 103. For example, the inner space of the ink needle 102 may be directly connected to the ink tube 20, and ink stored in the first storage chamber 32, the second storage chamber 33 and the ink valve chamber 35 is supplied to the recording head 21 through the inner space of the ink needle 102 and the ink tube 20.

In the above-described embodiment, the cartridge body 31 has a shape whose dimensions in the up-down direction and the front-rear direction are greater than the dimension in the left-right direction. However, the shape of the cartridge body 31 is not limited to the above-described shape. For example, the cartridge body 31 may have a shape whose dimension in the left-right direction is greater than the dimensions in the up-down direction and the front-rear direction.

The cartridge body 31 may be constituted by an integrally molded single container, or may be constituted by a plurality of components. A container whose upper end is open, and a lid configured to cover the upper end of the container can be exemplified as the plurality of components. Alternatively, for example, a film may be welded to the cartridge body 31 to constitute a part of the outer surfaces of the cartridge body 31.

Figure 11:
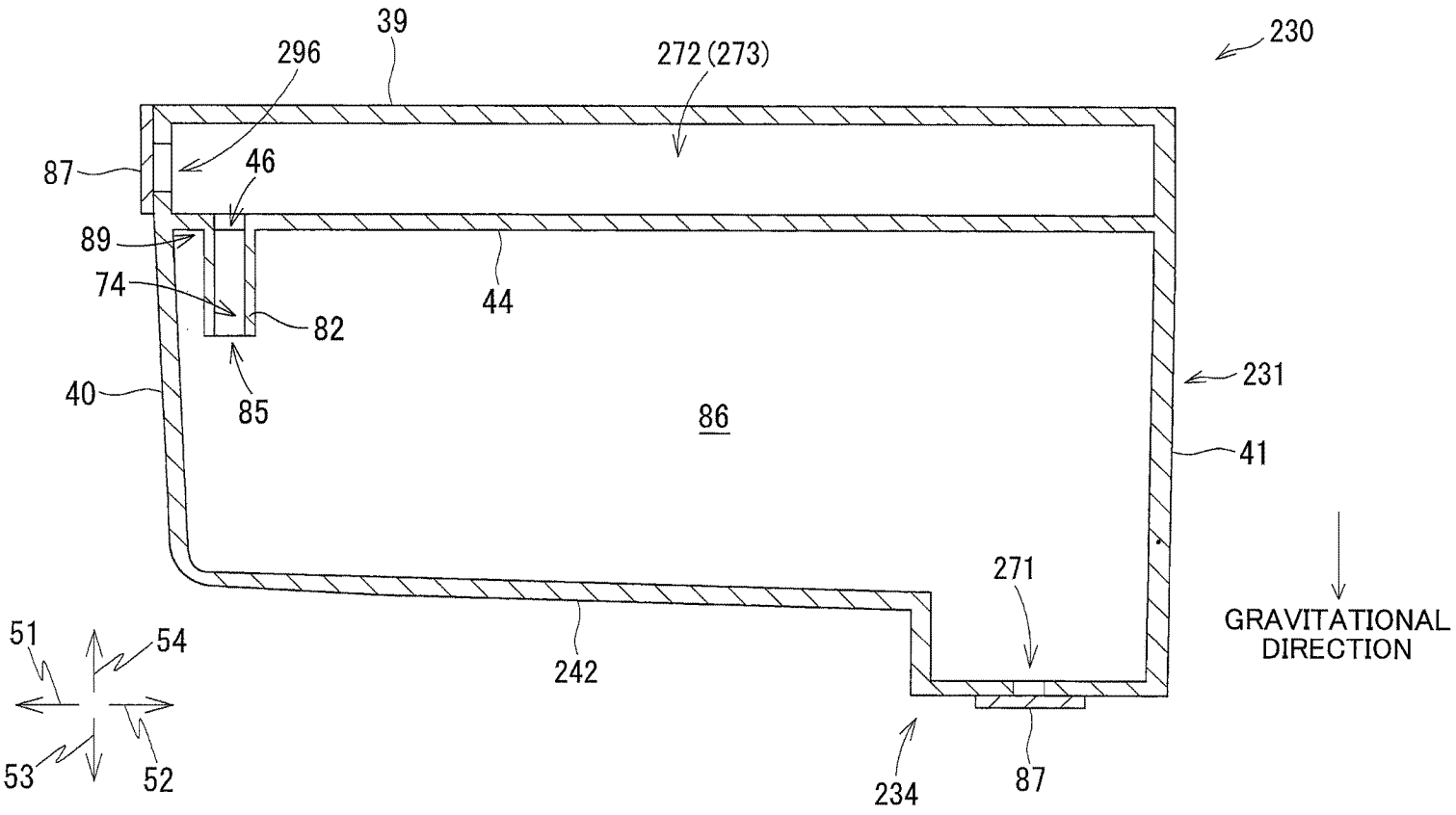
FIG. 11 is a vertical cross-sectional view of an ink cartridge 230 according to a modification of the embodiment.

Further, the cartridge body 31 may have a shape illustrated in FIG. 11. FIG. 11 illustrates an ink cartridge 230 according a modification to the embodiment. In this modification, the ink cartridge 230 has an outer shape defined by a cartridge body 231. The cartridge body 231 has a generally rectangular parallelepiped shape.

As illustrated in FIG. 11, an ink supply portion 234 protrudes downward from a bottom wall 242. In this modification, the ink cartridge 230 is inserted into the cartridge attachment section 110 in the gravitational direction. In the modification illustrated in FIG. 11, an upright posture of the ink cartridge 230 is coincident with a posture of the ink cartridge 230 when the ink cartridge 230 is inserted into the cartridge attachment section 110 in the gravitational direction, that is, the ink supply portion 234 of the ink cartridge 230 is directed in the gravitational direction. The ink cartridge 230 may be configured to be inserted into the cartridge attachment section 110 in the gravitational direction even when the ink supply portion 34 protrudes in a direction other than the downward direction 53 (gravitational direction).

The ink supply portion 34 need not necessarily protrude from the cartridge body 31. For example, the ink supply port 71 may be formed at the outer surface of the cartridge body 31.

While two ink storage chambers (the first storage chamber 32 and the second storage chamber 33) are provided within the cartridge body 31 in the above-described embodiment, the number of the ink storage chambers is not limited to two. In the modification illustrated in FIG. 11, the cartridge body 231 is formed with only one ink storage chamber 86. Alternatively, three or more ink storage chambers may be formed within the cartridge body 31.

In the above-described embodiment, the ink supply port 71 and the air communication port 96 are open and closed by the movement of valve 77 and the valve 97, respectively. However, another configuration for opening and closing the ink supply port 71 and air communication port 96 may be provided. For example, in the modification illustrated in FIG. 11, a seal 87 is attached to each of an ink supply port 271 and an air communication port 296. As a result, the ink storage chamber 86 is liquid-tightly sealed by the seals 87 so that ink stored in the ink storage chamber 86 is prevented from flowing out of the ink cartridge 230. In this modification, a needle or a rod breaks through the seals 87 welded to the ink supply port 271 and the air communication port 296 at the time of insertion of the ink cartridge 230 into the cartridge attachment section 110. As a result, ink stored in the ink storage chamber 86 can flow outside the ink cartridge 30 through the ink supply port 271. Further, the ink storage chamber 86 is open to the atmosphere through the air communication port 296. Further, in this modification, since the air valve chamber 36 is not provided in the ink cartridge 230, only an air chamber 273 is formed in the ink cartridge 230 at a position upward relative to the partition wall 44.

In the above-described embodiment, the air communication pipe 82 is positioned adjacent to the rear wall 41 in the first storage chamber 32. However, the air communication pipe 82 may be positioned adjacent to the front wall 40 in the first storage chamber 32, as illustrated in FIG. 11. In this case, when ink is injected to the first storage chamber 32, the second storage chamber 33 and the ink valve chamber 35 during manufacturing of the ink cartridge 30, it is preferable that the ink cartridge 30 is moved to be inclined such that the front end of the ink cartridge 30 is positioned upward relative to the rear end of the ink cartridge 30.

While ink serves as an example of the liquid in the above-described embodiment, the liquid of the present disclosure is not limited to ink. For example, a pretreatment liquid that is ejected onto sheets prior to ink during a printing operation may be stored in the liquid cartridge. Alternatively, cleaning water for cleaning the recording head 21 may be stored in the liquid cartridge. That is, the ink cartridge 30 according to the present disclosure need not be a cartridge for storing ink, but may be a cartridge for storing liquid consumed by the printer 10.

Operational and Technical Advantages of the Embodiment

According to the above-described embodiment, the opening 85 constituting one end of the air communication passage 72 is positioned at the upper portion of the first storage chamber 32. With this configuration, the ink cartridge 30 can reduce an amount of ink sucked from the first storage chamber 32 into the air communication passage 72 even when the atmospheric pressure of the outside of the ink cartridge 30 becomes low due to transfer of the ink cartridge 30 to a highland after its manufacture.

Figure 12:
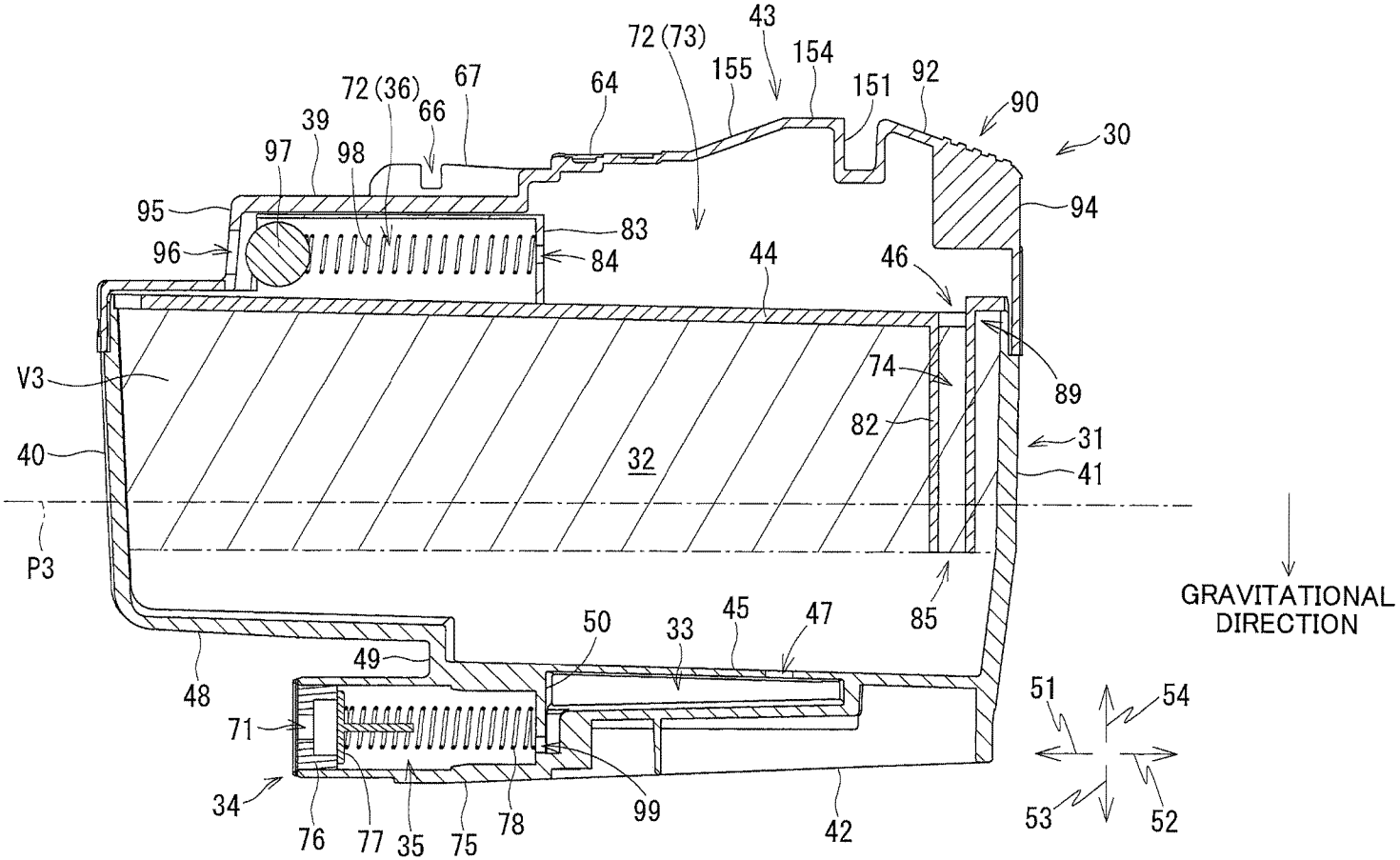
FIG. 12 is a vertical cross-sectional view of an ink cartridge 30 having a configuration in which a length of an air communication pipe 82 is greater than that of the ink cartridge 30 according to the embodiment.
Figure 13:
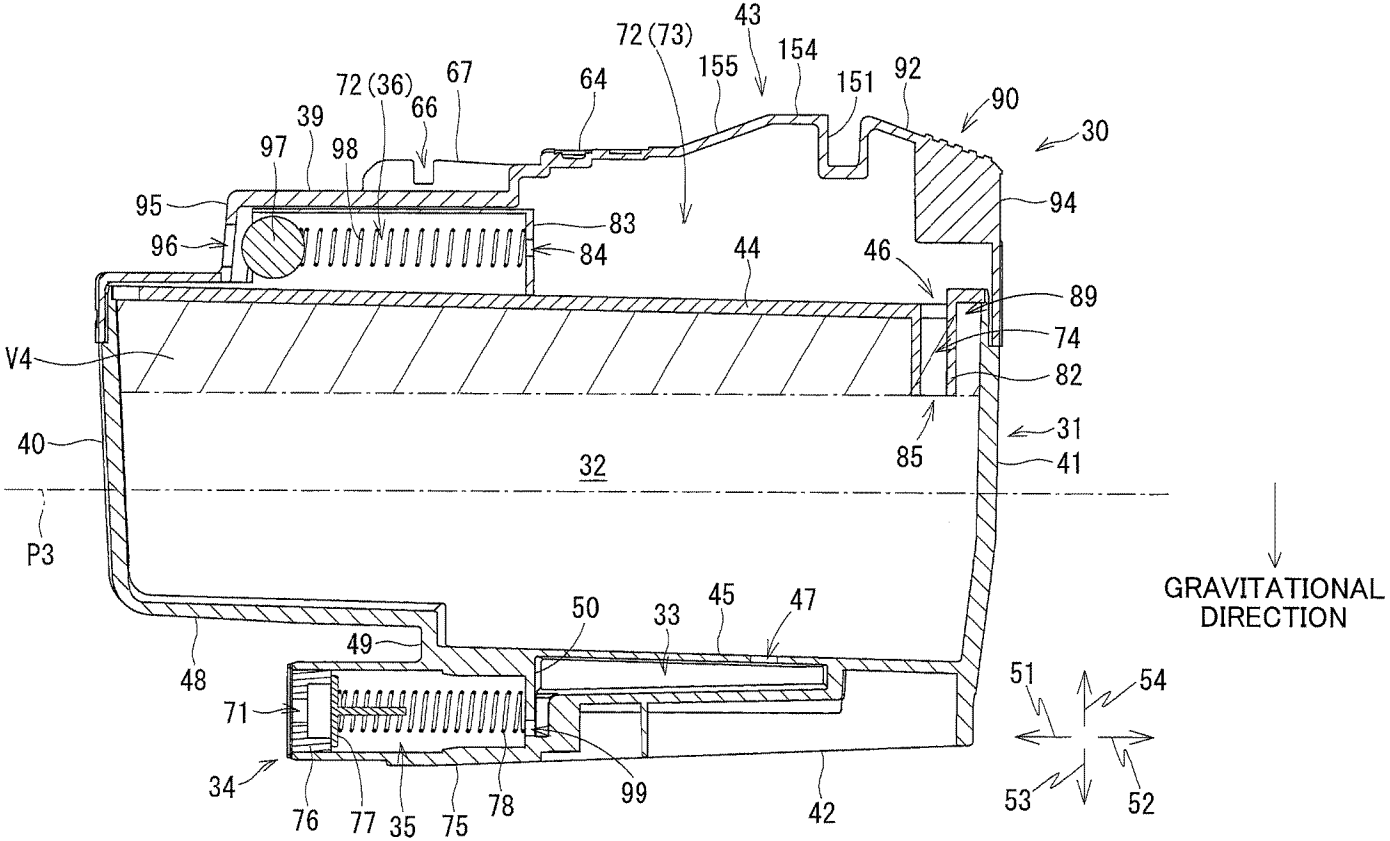
FIG. 13 is a cross-sectional view of the ink cartridge 30 according to the embodiment taken along the line VII-VII in FIG. 6B.
Figure 14:
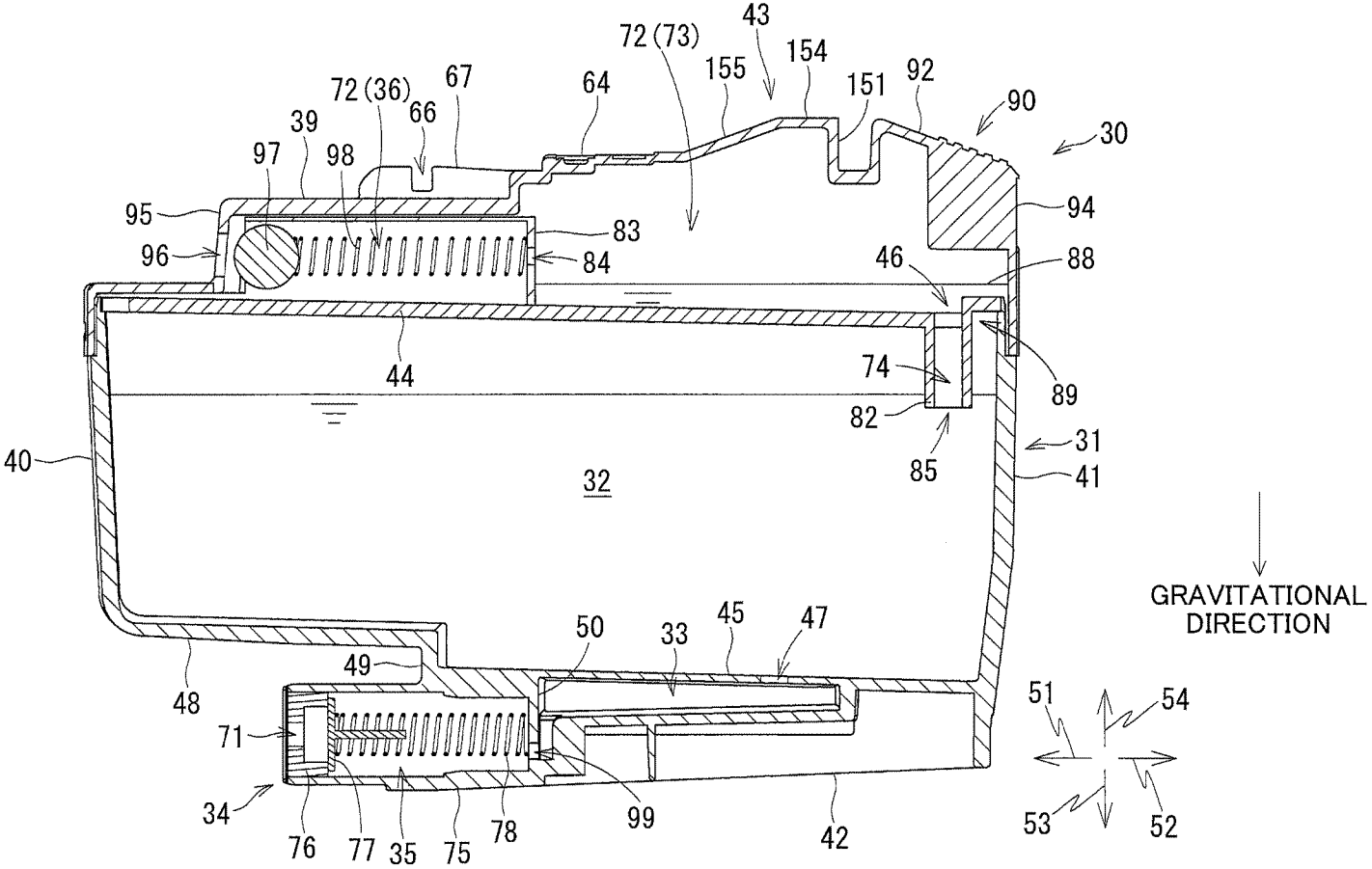
FIG. 14 is a cross-sectional view of the ink cartridge 30 taken along the line VII-VII in FIG. 6B, and illustrating a state in which ink stored in a first storage chamber 32 enters an air chamber 73.

FIG. 12 illustrates an example of the ink cartridge 30 having a configuration in which the air communication pipe 82 extends up toward the lower portion of the first storage chamber 32. In a case where the opening 85 of the air communication pipe 82 is positioned downward relative to the center position P3 in the up-down direction, an amount of ink that corresponds to a partial internal volume V3 illustrated in FIG. 12 is the maximum amount of ink that can flow from the first storage chamber 32 into the air chamber 73 through the opening 85. On the other hand, in the above-described embodiment, an amount of ink that corresponds to a partial internal volume V4 illustrated in FIG. 13 is the maximum amount of ink that can flow from the first storage chamber 32 into the air chamber 73 through the opening 85. The partial internal volume V4 is smaller than the partial internal volume V3. Thus, according to the above-described embodiment, an amount of ink flowing out of the first storage chamber 32 can be reduced.

Further, when the liquid surface of ink contacts the opening 85 constituting the one end of the air communication passage 72 during injecting of ink into the first storage chamber 32, since the air is no longer sucked from the first storage chamber 32 to the outside of the liquid cartridge 30, ink cannot be further injected into the first storage chamber 32. Thus, for injecting as much ink as possible into the first storage chamber 32, the cartridge body 31 is moved to be inclined after the liquid surface of ink reaches the opening 85. Assuming that the opening 85 is positioned at the lower portion of the first storage chamber 32 (see FIG. 12), even in a state where the cartridge body 31 is inclined, the liquid surface of ink stored in the first storage chamber 32 reaches the opening 85 again after a little amount of ink is further injected. Therefore, a large amount of ink cannot be injected into the first storage chamber 32. According to the above-described embodiment, since the opening 85 is positioned at the upper portion of the first storage chamber 32, a large amount of ink can be injected into the first storage chamber 32 as illustrated in FIG. 10.

According to the above-described embodiment, the air communication pipe 82 is positioned in the vicinity of the rear wall 41 in the first storage chamber 32. In this case, when the cartridge body 31 is moved to be inclined for injection of ink, the cartridge body 31 is inclined such that a rear portion of the first storage chamber 32 is positioned upward relative to a front portion of the first storage chamber 32. With this movement, a large amount of ink can be injected in the first storage chamber 32.

Further, according to the above-described embodiment, the first storage chamber 32 has the length in the front-rear direction greater than that in the left-right direction. Thus, a large amount of ink can be injected into the first storage chamber 32 in a case where the air communication pipe 82 is positioned adjacent to the rear wall 41 or adjacent to the front wall 40 in the first storage chamber 32.

The ink supply portion 34 is configured to supply ink in the first storage chamber 32 to outside of the ink cartridge 30. In the above-described embodiment, the ink supply portion 34 is also used as an injection port for injecting ink from outside of the ink cartridge 30 into the first storage chamber 32 as illustrated in FIG. 9. Since the ink cartridge 30 need not have an opening that functions as an injection port separately from the ink supply portion 34, a number of the openings formed at the ink cartridge 30 can be reduced. Accordingly, leakage of ink stored in the first storage chamber 32 can be further restrained.

Further, in the above-described embodiment, since the space constituted by the air chamber 73 and the air valve chamber 36 is elongated in the front-rear direction, the horizontal cross sectional area of the space is large compared to a case where the space is elongated in the up-down direction. Thus, even if ink is sucked into the air communication passage 72 to enter the space, a liquid surface of ink entered into the space (hereinafter referred to as a "liquid surface 88") is elongated in the front-rear direction, so that the horizontal cross sectional area of the liquid surface 88 becomes large. Accordingly, raise of the liquid surface 88 of ink in the space can be restrained. As a result, increase of the water head pressure of the liquid surface of ink can be prevented.

Further, according to the above-described embodiment, as illustrated in FIG. 8, the partial internal volume V1 in the first storage chamber 32 is smaller than the internal volume V2 of the space constituted by the air chamber 73 and the air valve chamber 36. Here, even in a case where the atmospheric pressure of outside of the ink cartridge 30 is reduced due to the transfer of the ink cartridge 30 to a highland after its manufacture and ink stored in the first storage chamber 32 flows into the air communication passage 72, ink in the first storage chamber 32 cannot further flow into the air chamber 73 and the air valve chamber 36 after the level of the liquid surface of the ink in the first storage chamber 32 becomes lower than the opening 85 constituting the one end of the air communication passage 72. That is, an amount of ink greater than the amount corresponding to the partial internal volume V1 does not enter the space constituted by the air chamber 73 and the air valve chamber 36. Accordingly, even if an amount of ink corresponding to the partial internal volume V1 enters the space constituted by the air chamber 73 and the air valve chamber 36, this configuration can prevent an entire space constituted by the air chamber 73 and the air valve chamber 36 from being filled with the ink. Thus, leakage of the ink from the space constituted by the air chamber 73 and the air valve chamber 36 to the outside of the cartridge body 31 can be restrained.

Assuming that the upper end of the air communication pipe 82 is positioned upward relative to the upper surface of the partition wall 44, in a case where ink enters the space constituted by the air chamber 73 and the air valve chamber 36, the ink remained in the space at a position downward of the upper end of the air communication pipe 82 cannot easily return to the first storage chamber 32. In the above-described embodiment, however, the upper end of the air communication pipe 82 is formed at a position lower than or equal to the upper surface of the partition wall 44 as illustrated in FIG. 7, so that the ink remained adjacent to the upper surface of the partition wall 44 can easily return to the first storage chamber 32.

Further, according to the above-described embodiment, the through hole 46 is formed at the partition wall 44 as illustrated in FIG. 7, so that ink flows from the first storage chamber 32 through the opening 85 constituting the one end of the air communication passage 72 into the air chamber 73 and the air valve chamber 36 can easily return to the first storage chamber 32 through the through hole 46.

Further, according to the above-described embodiment, the upper surface of the partition wall 44 is sloped downward toward the through hole 46. Therefore, the ink entered the air chamber 73 and the air valve chamber 36 through the opening 85 flows on the upper surface of the partition wall 44 and is introduced into the through hole 46. As a result, the ink flowing into the air chamber 73 and the air valve chamber 36 can easily return to the first storage chamber 32.

Further, according to the above-described embodiment, when the attachment of the ink cartridge 30 into the cartridge attachment section 110 is completed, ink flows from the first storage chamber 32 into the internal space of the tank 103 by virtue of a water head difference between the first storage chamber 32 and the tank 103. At this time, if the ink is sucked from the first storage chamber 32 into the opening 85 constituting the one end of the air communication passage 72 to enter the air chamber 73 and the air valve chamber 36, the ink in the air chamber 73 and the air valve chamber 36 moves toward the first storage chamber 32. Here, according to the above-described embodiment, the volume of the internal space of the tank 103 is greater than the internal volume V2 of the space constituted by the air chamber 73 and the air valve chamber 36. Accordingly, the ink that is sucked from the first storage chamber 32 into the opening 85 constituting the one end of the air communication passage 72 to enter the air chamber 73 and the air valve chamber 36 can completely return to the first storage chamber 32.

What is claimed is:

1. A liquid cartridge comprising:

a cartridge body having a liquid storage chamber configured to store liquid therein, the cartridge body comprising:

a liquid supply portion providing a liquid supply hole configured to supply the liquid stored in the liquid storage chamber to an outside of the liquid cartridge;

an air communication passage configured to communicate the liquid storage chamber with an atmosphere, the air communication passage including an air communication pipe extending in a gravitational direction in an upright posture of the liquid cartridge, the air communication pipe having one open end open to the liquid storage chamber and another open end opposite to the one open end, the another open end being positioned upward relative to the one open end in the upright posture of the liquid cartridge;

a front wall;

a rear wall spaced apart from the front wall in a front-rear direction perpendicular to the gravitational direction in the upright posture of the liquid cartridge;

a lower wall connecting a lower end of the front wall and a lower end of the rear wall in the upright posture of the liquid cartridge; and an upper wall extending in the front-rear direction between the front wall and the rear wall, the liquid storage chamber being positioned between the upper wall and the lower wall in the gravitational direction in the upright posture of the liquid cartridge, the air communication pipe protruding from the upper wall;

the front wall, the rear wall, the lower wall and the upper wall defining the liquid storage chamber, the one open end being positioned downward relative to a highest liquid level and upward relative to a center portion of the liquid storage chamber in an up-down direction parallel to the gravitational direction in the upright posture of the liquid cartridge, the highest liquid level being defined in a state where a maximum permissible amount of liquid is stored in the liquid storage chamber in the upright posture of the liquid cartridge;

wherein the cartridge body includes a buffer chamber positioned above the upper wall in the upright posture of the liquid cartridge and defined by a plurality of surfaces, the buffer chamber constituting a part of the air communication passage, the buffer chamber being formed with a liquid storage chamber side opening and an external side opening, the liquid storage chamber side opening being communicated with the air communication pipe to communicate the buffer chamber with the liquid storage chamber, the external side opening being configured to communicate the buffer chamber with the outside of the cartridge body, and wherein, in the upright posture of the liquid cartridge, the buffer chamber is formed in the cartridge body at a region between a first position and a second position, the first position being closer to the front wall than a center portion in the front-rear direction of the liquid storage chamber is to the front wall, the second position being closer to the rear wall than the center portion in the front-rear direction of the liquid storage chamber is to the rear wall.

2. The liquid cartridge according to claim 1, wherein the air communication pipe is positioned adjacent to one of the front wall and the rear wall.

3. The liquid cartridge according to claim 1, wherein, in the upright posture of the liquid cartridge, the liquid storage chamber has a length in the front-rear direction greater than a length of the liquid storage chamber in a widthwise direction perpendicular to the front-rear direction and the up-down direction.

4. The liquid cartridge according to claim 1, wherein the liquid supply hole is configured to allow liquid to be injected into the liquid storage chamber therethrough from the outside of the liquid cartridge.

5. The liquid cartridge according to claim 1, wherein the buffer chamber has an internal volume, and wherein, in the upright posture of the liquid cartridge, the liquid storage chamber has a partial internal volume at a region between an imaginary horizontal plane containing the one open end of the air communication passage and the highest liquid level, the partial internal volume of the liquid storage chamber being smaller than the internal volume of the buffer chamber.

6. The liquid cartridge according to claim 1, wherein, in the upright posture of the liquid cartridge, the plurality of surfaces includes a bottom surface defining a bottom end of the buffer chamber, and wherein, in the upright posture of the liquid cartridge, the air communication pipe has an upper end positioned not higher than the bottom surface of the buffer chamber.

7. The liquid cartridge according to claim 1, wherein, in the upright posture of the liquid cartridge, the plurality of surfaces includes a bottom surface defining a bottom end of the buffer chamber, and wherein the liquid storage chamber side opening is open at the bottom surface of the buffer chamber.

8. The liquid cartridge according to claim 7, wherein, in the upright posture of the liquid cartridge, the bottom surface of the buffer chamber is sloped downward toward the liquid storage chamber side opening.

9. The liquid cartridge according to claim 1, wherein, in the upright posture of the liquid cartridge, the liquid supply hole is formed at a position closer to the bottom wall than to the upper wall in the gravitational direction, the liquid supply hole being directed in a direction crossing the gravitational direction.

10. A liquid-consuming device comprising:

a liquid cartridge comprising:

a cartridge body having a liquid storage chamber configured to store liquid therein, the cartridge body comprising:

a liquid supply portion providing a liquid supply hole configured to supply the liquid stored in the liquid storage chamber to an outside of the liquid cartridge;

an air communication passage configured to communicate the liquid storage chamber with an atmosphere, the air communication passage including an air communication pipe extending in a gravitational direction in an upright posture of the liquid cartridge, the air communication pipe having one open end open to the liquid storage chamber and another open end opposite to the one open end, the another open end being positioned upward relative to the one open end in the upright posture of the liquid cartridge;

a front wall;

a rear wall spaced apart from the front wall in a front-rear direction perpendicular to the gravitational direction in the upright posture of the liquid cartridge;

a lower wall connecting a lower end of the front wall and a lower end of the rear wall in the upright posture of the liquid cartridge; and an upper wall extending in the front-rear direction between the front wall and the rear wall, the liquid storage chamber being positioned between the upper wall and the lower wall in the gravitational direction in the upright posture of the liquid cartridge, the air communication pipe protruding from the upper wall;

the front wall, the rear wall, the lower wall and the upper wall defining the liquid storage chamber, the one open end being positioned downward relative to a highest liquid level and upward relative to a center portion of the liquid storage chamber in an up-down direction parallel to the gravitational direction in the upright posture of the liquid cartridge, the highest liquid level being defined in a state where a maximum permissible amount of liquid is stored in the liquid storage chamber in the upright posture of the liquid cartridge, the cartridge body including a buffer chamber positioned above the upper wall in the upright posture of the liquid cartridge and defined by a plurality of surfaces, the buffer chamber constituting a part of the air communication passage, the buffer chamber being formed with a liquid storage chamber side opening and an external side opening, the liquid storage chamber side opening being communicated with the air communication pipe to communicate the buffer chamber with the liquid storage chamber, the external side opening being configured to communicate the buffer chamber with the outside of the cartridge body, the buffer chamber being formed in the cartridge body at a region between a first position and a second position, the first position being closer to the front wall than a center portion in the front-rear direction of the liquid storage chamber is to the front wall, the second position being closer to the rear wall than the center portion in the front-rear direction of the liquid storage chamber is to the rear wall, the buffer chamber having an internal volume;

a cartridge attachment section to which the liquid cartridge is attachable, the cartridge-attachment section having a main body side liquid storage chamber configured to be communicated with the liquid supply hole of the liquid cartridge to store liquid supplied through the liquid supply hole in a state where the liquid cartridge is attached to the cartridge-attachment section, the main body side liquid storage chamber having an internal volume greater than the internal volume of the buffer chamber; and a consuming section configured to consume the liquid stored in the main body side liquid storage chamber.

11. The liquid-consuming device according to claim 10, wherein the buffer chamber has an internal volume, and wherein, in the upright posture of the liquid cartridge, the liquid storage chamber has a partial internal volume at a region between an imaginary horizontal plane containing the one open end of the air communication passage and the highest liquid level, the partial internal volume of the liquid storage chamber being smaller than the internal volume of the buffer chamber.

12. The liquid-consuming device according to claim 10, wherein, in the upright posture of the liquid cartridge, the plurality of surfaces includes a bottom surface defining a bottom end of the buffer chamber, and wherein, in the upright posture of the liquid cartridge, the air communication pipe has an upper end positioned not higher than the bottom surface of the buffer chamber.

13. The liquid-consuming device according to claim 10, wherein, in the upright posture of the liquid cartridge, the plurality of surfaces includes a bottom surface defining a bottom end of the buffer chamber, and wherein the liquid storage chamber side opening is open at the bottom surface of the buffer chamber.

14. The liquid-consuming device according to claim 13, wherein, in the upright posture of the liquid cartridge, the bottom surface of the buffer chamber is sloped downward toward the liquid storage chamber side opening.

15. The liquid-consuming device according to claim 10, wherein, in the upright posture of the liquid cartridge, the liquid supply hole is formed at a position closer to the bottom wall than to the upper wall in the gravitational direction, the liquid supply hole being directed in a direction crossing the gravitational direction.

* * * * *